US006036035A

United States Patent [19]

Asano et al.

[11] Patent Number: 6,036,035

[45] Date of Patent: Mar. 14, 2000

[54] APPARATUS AND METHOD FOR EXTENDING AND STORING JIB OF CRANE

[75] Inventors: Kazuyoshi Asano, Kawagoe; Takeshi Hasegawa, Hidaka; Masayuki Mukaino, Sayama, all of Japan

[73] Assignees: Komatsu Ltd.; Komatsu MEC Kabushiki Kaisha, both of Tokyo, Japan

[21] Appl. No.: 09/155,809

[22] PCT Filed: Apr. 2, 1997

[86] PCT No.: PCT/JP97/01141

§ 371 Date: Oct. 5, 1998

§ 102(e) Date: Oct. 5, 1998

[87] PCT Pub. No.: WO97/37927

PCT Pub. Date: Oct. 16, 1997

[30] Foreign Application Priority Data

Apr. 5, 1996 [JP] Japan ..... 8-108743
Aug. 7, 1996 [JP] Japan ..... 8-224356

[51] Int. Cl.[7] ..... B66C 23/68

[52] U.S. Cl. ..... 212/300; 212/168; 212/270

[58] Field of Search ..... 212/168, 292, 212/299, 300, 347, 270

[56] References Cited

U.S. PATENT DOCUMENTS

| | | | |
|---|---|---|---|
| 4,828,124 | 5/1989 | Iga | 212/188 |
| 5,115,925 | 5/1992 | Koizumi | 212/300 |
| 5,143,233 | 9/1992 | Loizumi | 212/300 |

FOREIGN PATENT DOCUMENTS

| | | |
|---|---|---|
| 5-139693 | 6/1993 | Japan . |
| 6-76283 | 10/1994 | Japan . |
| 63-27396 | 2/1998 | Japan . |

*Primary Examiner*—Thomas J. Brahan
*Attorney, Agent, or Firm*—Sidley & Austin

[57] ABSTRACT

The present invention relates to an apparatus and a method for extending and storing a jib of a crane which make it possible to simplify the operation of changing a wire rope. The apparatus includes an end sheave (23), which is detachably attached to the front lower end of a boom (3); a rotating device, (80) for rotating a rotary bracket (30); and a link (123), which vertically rotatably connects the end sheave (23) and the front upper portion of the boom (3) and positions the end sheave (23) above and in front of the boom (3) when the rotary bracket (30) is rotated in the forward direction of the boom (3).

15 Claims, 34 Drawing Sheets

APPARATUS AND METHOD FOR EXTENDING AND STORING JIB OF CRANE

TECHNICAL FIELD

The present invention relates to an apparatus and a method for extending and storing a jib of a mobile crane.

BACKGROUND ART

Some mobile cranes include a jib in addition to a boom which can be freely extended and shortened. Such a crane provided with a jib is illustrated in FIG. 32, for example. A conventional mobile crane provided with a jib will be described hereinafter with reference to FIG. 32. The mobile crane includes an upper revolving superstructure 8, which is free to revolve; a lower traveling body 1; and a boom 3, which is freely extended and shortened and is freely raised and lowered, nearly in the center of the upper revolving superstructure 8. Outriggers 2 are provided in front of and behind and on both sides of the lower traveling body 1 in order to maintain the safety of the body of the vehicle during an operation of the crane. When the boom 3 is, for example, a three-stage telescopic boom, the boom 3 comprises a base boom 4, an intermediate boom 5, and a top boom 6.

The mobile crane includes a main hook 10 at the front end of a wire rope 11 for the main hook 10, which is hung from the front end portion of the top boom 6, and lifts loads with the main hook 10. The operation of a winch makes it possible to windup or let out the wire rope 11 or to extend, shorten, raise, lower, and rotate the boom 3 so as to move loads to a predetermined height and position. However, there are cases where a working range of the boom 3 only is so small that the working range needs to be further enlarged depending on the circumstances of the working site where the mobile crane is placed.

In order to achieve the enlargement of the working range, a jib 7 is connected to the front end portion of the top boom 6, whereby an operation by the jib 7 can be conducted. When not being used, the jib 7 is disconnected from the top boom 6 and is stored, for example, on the left side of the base boom 4 as shown in FIG. 32. When being used, the jib 7 is rotated and extended outwardly in front of the top boom 6. Therefore, the jib 7 is rotatably connected to the top boom 6 via connecting pins 35*a* and 35*b*, which are provided respectively on the top and the bottom of the left side of the front end portion of the top boom 6. The jib 7 can be rotated around the connecting pins 35*a* and 35*b* within the angle range from the left side of the top boom 6 to the front thereof so as to be extended ahead of the top boom 6.

The jib 7 comprises a jib body 40, a jib bracket 30 for connecting the jib body 40 to the front end portion of the top boom 6, and a jib derricking cylinder 50 for raising or lowering the jib body 40 in relation to the jib bracket 30. The jib bracket 30 is rotatably connected to the jib body 40 via a pivot pin 31, which is vertical to the longitudinal axis of the jib body 40 in a horizontal surface. The jib derricking cylinder 50 is rotatably connected to the jib bracket 30 via a pivot pin 51, which is parallel to the pivot pin 31; and the jib derricking cylinder 50 is rotatably connected to the jib body 40 via a pivot pin 52, which is parallel to the pivot pin 31. The jib body 40 is raised or lowered around the pivot pin 31 in relation to the jib bracket 30 by extending or contracting the jib derricking cylinder 50.

A guide sheave 22, for guiding a wire rope 21 for the auxiliary hook 20, is provided on the upper face of the front end portion of the top boom 6. An end sheave 23, for guiding the wire rope 21 from the guide sheave 22 to the auxiliary hook 20, is provided on the front face of the front end portion of the top boom 6. A guide sheave 32, for guiding the wire rope 21 for the auxiliary hook 20 to the front end of the jib body 40, is provided on the upper face of the jib bracket 30. When the jib 7 is not used, the wire rope 21 for the auxiliary hook 20 is wound up and let out by way of the end sheave 23. When loads are lifted by the jib 7, the auxiliary hook 20 is used. Therefore, the wire rope 21 needs to be changed. The wire rope 21 is removed from the end sheave 23. After the jib 7 is extended, the wire rope 21 is guided from the guide sheave 22, at the front end portion of the top boom 6, to the sheave 23, at the front end portion of the jib body 40, by way of the above guide sheave 32 so as to be used when the jib 7 is being utilized.

When not being used, the jib 7 is usually stored on a side face of the base boom 4. When the jib 7 is stored on the left side face of the base boom 4, brackets are provided at the base boom 4 and the jib body 40, respectively, in order to fix the jib body 40.

In FIG. 33, a bracket 46, having engaging pins 46*a* and 46*b*, is fixed almost at the central position of the right side of the jib body 40; and a bracket 47*b* is fixed to the front end portion 40*b* of the right side of the jib body 40. Moreover, a bracket 45 and a bracket 47*a* are fixed at predetermined positions, corresponding to the bracket 46 and the bracket 47*b*, respectively, on the left side of the base boom 4.

Holes in which a securing pin 48 is inserted are respectively provided in the bracket 47*a* and the bracket 47*b*. When the jib 7 is stored, both holes are aligned and fixed with the securing pin 48. FIG. 34 is a drawing of the bracket 45 and the bracket 46 seen from an arrow 34 in FIG. 33. The bracket 45 has holes 45*a* and 45*b* which are bored through in a longitudinal direction of the base boom 4. The bracket 46 has the engaging pins 46*a* and 46*b* which are respectively inserted and engaged in the holes 45*a* and 45*b* from ahead of the base boom 4. When the jib 7 is stored, the jib body 40 is fixed to the base boom 4 in the state that the engaging pins 46*a* and 46*b* are respectively engaged in the holes 45*a* and 45*b*.

FIG. 35 shows a plan view of a connecting portion of the top boom 6 and the jib bracket 30. It will be described in detail below with reference to FIG. 35.

The brackets 27*a* and 27*b* are provided on the top and the bottom respectively, of a left side face 6*a* of the front end portion of the top boom 6; and the brackets 28*a* and 28*b* are provided on the top and the bottom, respectively, of a right side face 6*b* thereof. In the forward direction of the boom 3 in the state that the jib 7 is stored on the left side of the base boom 4, the brackets 33*a* and 33*b* are provided on the top and the bottom, respectively, of the right side of the front end portion of the jib bracket 30; and the brackets 34*a* and 34*b* are provided, respectively, on the top and the bottom of the left side thereof. A connecting hole is provided in each of the brackets. The brackets 27*a*, 27*b*, 28*a*, and 28*b* are connected to the brackets 33*a*, 33*b*, 34*a*, and 34*b* with connecting pins 35*a*, 35*b*, 36*a*, and 36*b*, respectively. In this embodiment, an axis, which links cores of the connecting pins 35*a* and 35*b*, is included in a vertical surface and in addition is in a vertical direction to the longitudinal axis of the boom 3.

A rotating cylinder 55, for rotating the jib 7 nearly 180 degrees to the top boom 6 around the connecting pins 35*a* and 35*b*, is provided. A bracket 37 is provided on the right side of the rear end portion (the portion close to the jib body 40) of the jib bracket 30. One end of the rotating cylinder 55 is rotatably attached to the bracket 37 with a pivot pin 38. The other end of the rotating cylinder 55 is attached to one end of a bracket 56. The other end of the bracket 56 is rotatably connected to one end of a link member 57 and one end of a link member 58 with a pivot pin 59. A bracket 25 is provided on the left side face 6*a* of the front end portion of the top boom 6. The other end of the link member 57 is rotatably connected to the bracket 25 with a pivot pin 26. The other end of the link member 58 is rotatably connected via a pivot pin 39 to a portion on the top of the right side of the front end portion of the jib bracket 30 close to the front portion of the bracket 33*a*.

The pivot pins 26, 59, and 39, and the connecting pin 35*a* compose a four node link. When the rotating cylinder 55 is extended, the pivot pin 59 is pushed ahead of the top boom 6 and the four node link operates to enlarge an angle formed by the link member 57 and the link member 58. Following this operation, the pivot pin 26 and the pivot pin 39 receive a force to move away from each other, with the connecting pin 35*a* as a center. Thus, the jib bracket 30 is rotated around the connecting pin 35*a* in the forward direction of the top boom 6. When the rotating cylinder 55 is contracted, contrary to the above, the pivot pin 59 is pulled behind the top boom 6 and the four-node link operates to make the angle formed by the link member 57 and the link member 58 smaller. Thus, the jib bracket 30 is rotated around the connecting pin 35*a* toward a side of the top boom 6.

When the jib 7 is used in the aforesaid structure, the jib 7 is extended in front of the front portion of the top boom 6 and is connected thereto. Thereafter, the wire rope 21 needs to be changed in order to guide the wire rope 21 for the auxiliary hook 20 from the front portion of the top boom 6 to the front portion of the jib body 40. FIG. 36 shows the process of extending the jib 7 and changing the wire rope 21, and FIGS. 37–40 are drawings for explaining this process. Detailed explanation will be made below with reference to FIGS. 36–40. Incidentally, in the following explanation, each step of the process is represented by "S". For example, "S21" represents "step 21".

FIG. 37 shows an initial condition of the process. Here, as preparations for extending the jib 7, the outrigger 2 of the lower traveling body 1 is extended to the maximum extent.

S21: The boom 3 is made nearly horizontal with its shortest length.

S22: The wire rope 21 for the auxiliary hook is winched out and loosened (which is the state of a wire rope 21*a* in FIG. 37), to make the auxiliary hook 20 touch a ground surface GL and lay down.

S23: The securing pin 48 (See FIG. 33) of the jib 7 is removed and the jib bracket 30 is pushed toward the top boom 6 side by human power or a hydraulic actuator and the like. This operation is called "swing a jib out".

S24: The connecting holes of the brackets 27*a* and 27*b* on the left side face 6*a* of the front end portion of the top boom 6 and the connecting holes of the brackets 33*a* and 33*b* at the front right end portion of the jib bracket 30 are matched and connected by inserting the connecting pins 35*a* and 35*b* therein, respectively.

S25: The wire rope 21 for the auxiliary hook is removed from the end sheave 23 and hung along the right side of the top boom 6, which is the state of the wire rope 21 in FIG. 37.

S26: The boom 3 is Gradually raised to a predetermined angle. At this time, the boom 3 is raised while the wire rope 21 is loosened so as to keep the auxiliary hook 20 touching the ground surface.

S27: The boom is extended from its shortest condition by a predetermined length.

FIG. 38 shows a side elevational view of a mobile crane in the aforesaid condition. While the boom 3 is raised, the wire rope 21 keeps hanging alone, the right side of the top boom 6 from the guide sheave 22 on the upper face of the front end portion of the top boom 6. Subsequently, when the boom is extended from its shortest condition by the predetermined length, the jib body 40 is pulled upwardly in the forward direction of the boom with the extension of the boom 3, since the front portion of the jib bracket 30 is connected to the top boom 6 via the connecting pins 35*a* and 35*b*. Then, the engaging pins 46*a* and 46*b* of the jib 7 are removed from the holes 45*a* and 45*b* of the bracket 45 (See FIG. 34). In this condition, the jib derricking cylinder 50 is locked in a stopped condition; therefore, the jib body 40 is supported to the jib bracket 30 by the jib derricking cylinder 50.

S28: The jib derricking cylinder 50 is operated to the jib body 40 downwardly so as to be nearly vertical to the longitudinal axis of the boom 3.

FIG. 39 shows the aforesaid condition. The jib body 40 is rotated around the pivot pin 31 by the jib derricking cylinder 50 to the position 40*a* and is nearly vertical to the longitudinal axis of the boom 3. At this time, the front end portion of the jib 7 gets closer to the ground surface GL, since the boom 3 is raised by the predetermined angle and extended by the predetermined length.

S29: The rotating cylinder 55 is extended to rotate the jib bracket 30 and the jib body 40 by 180 decrees around the connecting pins 35*a* and 35*b* so as to extend the jib body 40 in front of the top boom 6 (at the position 40*b* in FIG. 39).

S30: While the jib derricking cylinder 50 is operated to rotate the jib body 40 around the pivot pin 31 and raise the same, the boom 3 is gradually pivoted downwardly so that the jib body 40 and the boom 3 will be nearly horizontal.

FIG. 40 shows the aforesaid condition. When the jib body 40 and the boom 3 are nearly horizontal, the auxiliary hook 20 is laid down at the same position 20*a* where the auxiliary hook 20 was placed on the ground surface GL in the initial step of the process, that is, near the front end portion of the top boom 6.

S31: The holes of the brackets 28*a* and 28*b* on the right side face 6*b* of the front end portion of the top boom 6 and the holes of the brackets 34*a* and 34*b* of the jib bracket 30 are aligned and connected by inserting the connecting pins 36*a* and 36*b* therein, respectively (See FIG. 35).

S32: The auxiliary hook 20 and the wire rope 21 are moved to be near to the front end portion of the jib 7. The wire rope 21 is inserted into the guide sheave 32 on the upper face of the jib bracket 30, a load sheave 41, and a guide sheave 42 at the front end portion of the jib body 40.

At this time, as shown in FIG. 40, an operator carries the auxiliary hook 20 to a position 20*b* close to the front end portion of the jib 7. Moreover, the operator is also required to carry the wire rope 21 for changing the same.

As described above, in a conventional method for extending a jib, after the jib 7 is extended, operators are required to carry the auxiliary hook 20 from the vicinity of the front end portion of the boom 3 to the vicinity of the front end portion of the jib 7. As the operators must carry the heavy auxiliary hook 20, there occur disadvantages in that the operability is low and the operators' fatigue becomes larger.

In addition, when the wire rope 21 is changed, since the wire rope 21 is heavy, the operators move the wire rope 21 while letting the wire rope 21 touch the ground surface during the movement. Therefore, the wire rope 21 becomes dirty, which easily causes a reduction in the life of the wire rope 21, abrasion of other portions, or the like. When the wire rope 21 is let out while the auxiliary hook 20 is placed on the ground surface, a winch can be unwound without applying tension to the wire rope 21, whereby disordered winding occurs early when the wire rope 21 is wound up on a winch drum.

In addition, after the jib 7 is extended, the wire rope 21 needs to be changed by inserting it into the guide sheave 32 of the above frame body, the guide sheave 42 of the jib 7, and the load sheave 41 of the jib 7. This operation of changing the rope is conducted at a high spot for which a stepladder is necessary, so that it is dangerous and a very laborious operation for operators. This operation is a heavy operation in that operators directly touch the wire rope 21 with their hands. Therefore, their hands become smeared with oil or dirt from the wire rope 21, and this operation may cause injuries. Furthermore, this operation takes a lot of time, thereby causing a poor operating efficiency and a heavy burden for operators. When the jib 7 is swung outwardly and one side of the jib bracket 30 and one side of the top boom 6 are connected, the alignment of the connecting holes for connecting them is difficult. Even after the connecting holes are aligned, operators are required to insert the pins. Accordingly, this operation needs a person's assistance.

SUMMARY OF THE INVENTION

The present invention is made to eliminate the aforesaid disadvantages of the conventional art, and its object is to provide an apparatus and a method for extending and storing a jib of crane which make it possible to easily attach and detach a auxiliary hook without carrying the auxiliary hook and a wire rope to simplify the operation of changing the wire rope, and moreover to easily align the connecting holes of a rotary bracket and the front end of a boom when the jib is swung outwardly.

An apparatus for extending and storing a jib of a crane according to the present invention is an apparatus for extending and storing a jib of a crane, having a jib, which can be stored parallel to a side face of a boom, and a rotary bracket, which is derrickably attached to the jib and is rotatably attached to the front end of the boom, whereby the rotary bracket can be rotated to swing out the jib in front of the boom, and to connect the boom and the jib at the front end portion of the boom when the jib is to be used; and the apparatus is characterized by including:

an end sheave detachably attached to the lower portion of the front end of the boom, a rotating device for rotating the rotary bracket, and a link for vertically rotatably connecting the end sheave and the front upper portion of the boom and for positioning the end sheave above and in front of the boom when the rotary bracket is rotated in the forward direction of the boom. The end sheave can also serve as a guide sheave for a wire rope for an auxiliary hook when the jib is extended.

According to the above structure, the end sheave can be rotated in the forward and upward direction of the boom and moreover can also serve as the guide sheave for the wire rope for the auxiliary hook, since the end sheave at the front lower end of the boom and the front upper portion of the boom are rotatably connected with the link.

The apparatus can also include a jib derricking cylinder for connecting the rotary bracket and the jib, so that when the rotating device rotates the jib in the forward direction of the boom after the jib derricking cylinder turns the jib downwardly from a storing position of the jib, the jib is nearly vertical to a ground surface and a relative angle between the jib and the boom is not more than about 85 degrees. In addition, when the jib turns downwardly and rotates, the position of the center of gravity of the jib can be on a rotation center line of the rotary bracket in relation to the boom. According to the aforesaid structure, the center of gravity of the jib is located on a rotation center line of the rotary bracket, thereby reducing the rotation driving force for rotating the jib.

Moreover, when the jib is nearly vertical to the ground surface, it is desirable that the end sheave, a guide sheave attached to the front end portion of the jib, and a load sheave attached to the front end of the jib are nearly on a straight line as seen from ahead.

According to the aforesaid structure, when the jib is nearly vertical to the ground surface, the end sheave and the guide sheave are located nearly on a straight line as seen from ahead. Thus, if the auxiliary hook is hung down near to the ground surface via the end sheave and then the jib is raised, the wire rope is automatically inserted into the guide sheave. Accordingly, it is not necessary to drag the auxiliary hook or the wire rope on the ground surface or for an operator to carry them. The operation by an operator of changing the wire rope is no longer necessary.

The apparatus can include a link rotation drive unit for rotating the link at the front end portion of the boom. The link rotation drive unit can include an intermediate lever, driven by a cylinder lock which connects one end portion of the boom and one end portion of the rotary bracket, both in a lateral direction, and a connecting rod for connecting the link and the intermediate lever. In addition, the apparatus can include a connecting link for connecting the front end portion of the link and the front end portion of the boom when the link is rotated upwardly to a predetermined position.

The rotating device can include: the rotary bracket; a first link, one end of which is rotatably attached to a pin fixed on the upper face of the rotary bracket; a second link, one end of which is rotatably attached to the other end of the first link; a cylinder lock, connecting in an extended condition one end portion of the boom and one end portion of the rotary bracket, both in a lateral direction; a third link, rotatably attached to the cylinder lock, the front end of which is rotatably connected to the other end of the second link; and a rotating cylinder, one end of which is connected to the rotary bracket and the other end of which is connected to the first link.

According to the aforesaid structure, the position of the other end of the second link is stably fixed. Thus, when the jib, which is stored parallel to the side face of the boom, is swung outwardly, the engaging portions of the top boom and the rotary bracket can be easily engaged.

The rotary bracket can include a first through pin-hole and a second through pin-hole, located on one side out of both sides of the base end of the rotary bracket, which are connected to one side of the front end of the boom by a first connecting pin and a third connecting pin, respectively, both of which are disposed in a vertical direction, and a third through pin-hole and a fourth through pin-hole on the other side, out of both sides of the base end, which are connected to the other side out of both sides of the front end of the boom by connecting pins which are disposed in a vertical direction.

The other end of the second link can include a fifth through pin-hole which is connected by a second connecting pin to one side out of both sides of the front end of the boom and the front end of the third link. Besides, the cylinder lock can include a first connecting pin and a third connecting pin at the rear end portion of a cylinder of the cylinder lock and at the front end portion of a piston rod of the cylinder lock, which are engaged in a first through pin-hole and a second through pin-hole, respectively, on one side out of both sides of the base end of the rotary bracket, and a second connecting pin at the front end of the third link, which is engaged in a fifth through pin-hole at the other end of the second link.

The apparatus can include a second positioning means for positioning a second connecting pin, which is provided at the front end of the third link, at a predetermined position when the rotating cylinder is shortened. According to the aforesaid structure, the second connecting pin of the third link and an engaging portion of the rotary bracket can be easily matched by the second positioning means in the state that the rotating cylinder is contracted.

Moreover, the apparatus can include a first positioning means for adjusting a relative position between the rotary bracket and the front end of the boom when the bracket is swung outwardly in the forward direction of the boom. According to such a structure, when the rotating cylinder is extended and the rotary bracket is rotated in relation to the boom to swing out the jib, the engaging portions of the front end of the boom and the rotary bracket are easily matched by the first positioning means so that the rotary bracket and the front end of the boom can be locked.

A method for extending and storing a jib of a crane according to the present invention is a method for extending and storing a jib of a crane which attaches a wire rope for an auxiliary hook, guided by an end sheave disposed on the front lower end of a boom, and which needs to change the wire rope when the jib is moved between a storage position on a side face of the boom and a position extended from the side face of the boom, and is characterized by including the steps of turning the jib downwardly at a storing position thereof after rotating an end sheave above and in front of the boom, and thereafter rotating the jib in the forward direction of the boom, when the jib is extended.

Furthermore, it is preferable that when being turned downwardly, the jib is turned downwardly so as to be nearly vertical to a ground surface after being rotated in the forward direction of the boom, and is thereafter raised forwardly after being rotated in the forward direction of the boom and that the wire rope is automatically inserted into a guide sheave at the front end of the jib.

According to the invention of the aforesaid method, similarly to the invention of the aforesaid apparatus, it is no longer necessary for an operator to carry a wire rope and the like or to change the wire rope.

BEST MODE FOR CARRYING OUT THE INVENTION

Preferable embodiments of the present invention will be described in detail hereinafter with reference to the attached drawings.

Figure 1:
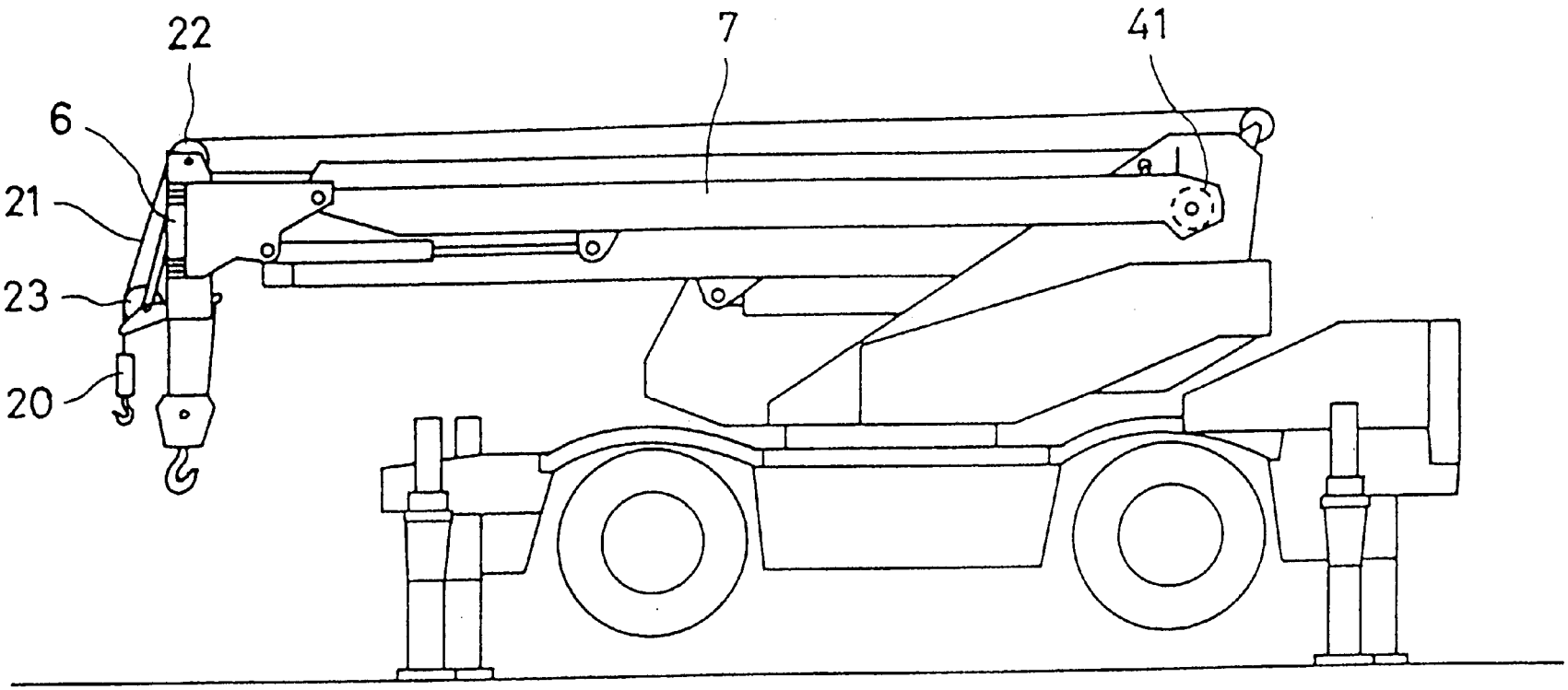
FIG. 1 is a side elevational view of a crane provided with a device for changing a wire rope in an apparatus for extending and storing a jib according to the present invention.
Figure 2:
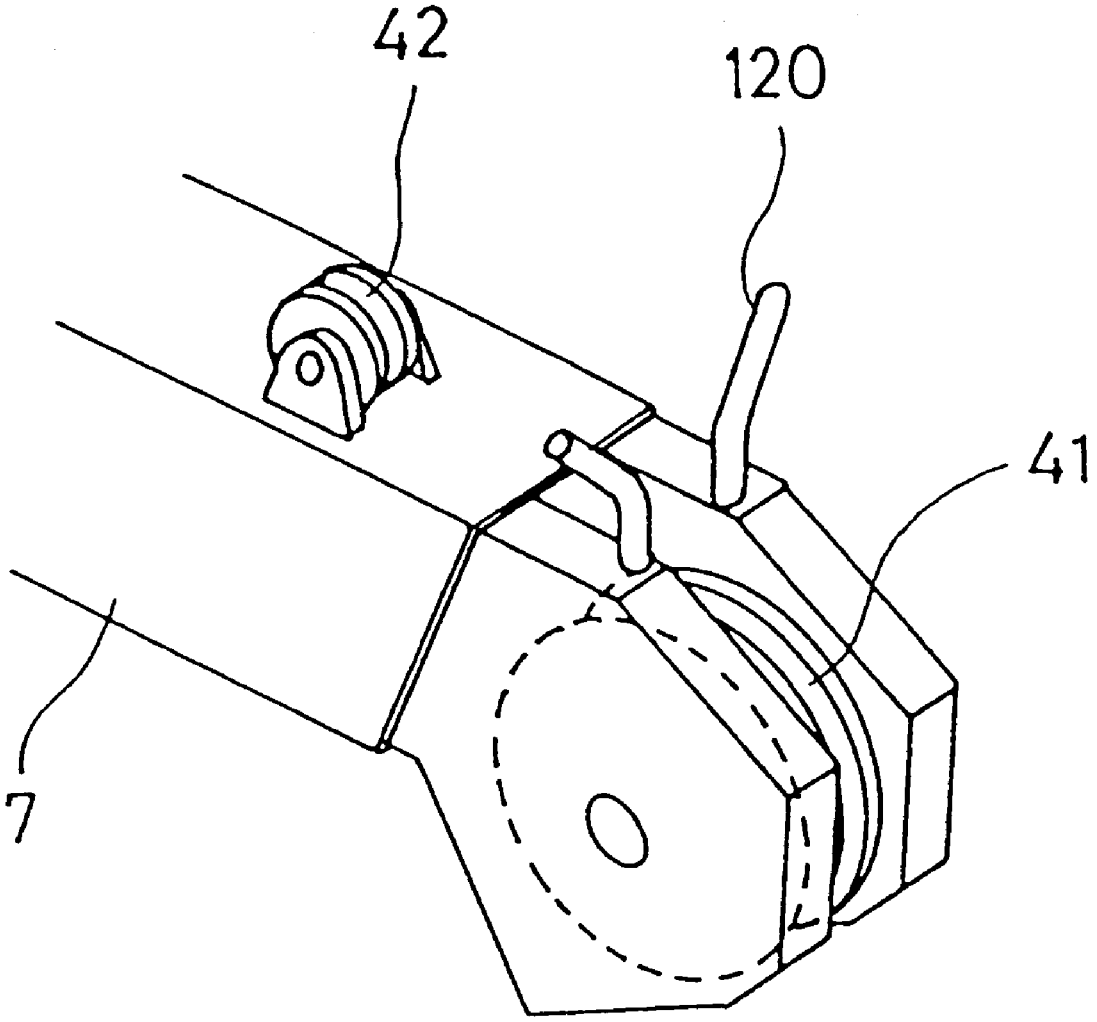
FIG. 2 is a perspective view of the front end portion of the jib in FIG. 1.

In FIG. 1, an end sheave 23 is detachably attached to the lower portion of the front end of a top boom 6. A wire rope 21, for an auxiliary hook 20, is inserted into the end sheave 23 by way of a guide sheave 22, provided on a front upper portion of the top boom 6. FIG. 2 is a perspective view of the front end portion of a jib 7. A load sheave 41 and a guide sheave 42 are attached to the front end portion of the jib 7. In addition, a wire rope guide 120 for guiding the wire rope 21 is provided thereon.

Figure 3:
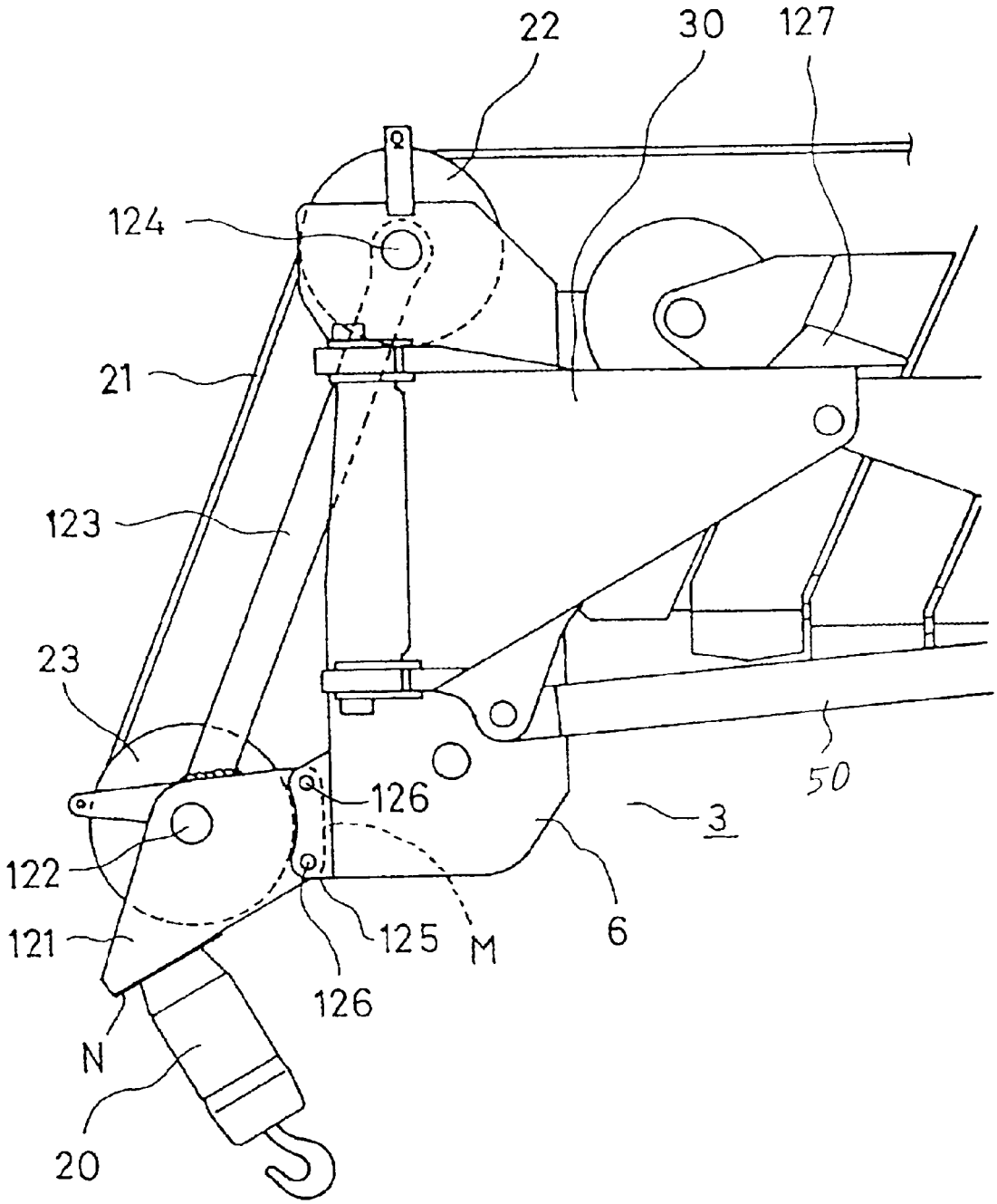
FIG. 3 is a side elevational view of the front end portion of a top boom showing the first embodiment of the device for changing the wire rope according to the present invention.

FIG. 3 shows the first embodiment of a device for changing a wire rope. A single top 121 is detachably attached to a bracket 125, provided at the lower portion of the front end of the top boom 6, via securing pins 126. The end sheave 23 is attached to the single top 121 via an end sheave axle 122. One end of a single top link (link) 123 is fixed to the single top 121 and the other end of the single top link 123 is rotatably attached to or near a guide sheave axle 124 of the guide sheave 22, provided on the upper portion of the top boom 6. In this condition, the operation of lifting a load or the like with the auxiliary hook 20 at the front end of the top boom 6 is possible. Incidentally, a multistage telescopic boom 3 is shown in the illustration, but the jib 7 can also be rotatably attached to only a single-stage boom.

A supporting base 127 is fixed on the right front end portion of a rotary bracket 30 as shown in the illustration. When the single top 121 is raised above and in front of the top boom 6 and the rotary bracket 30 is rotated 180 degrees in the forward direction of the top boom 6, the supporting base 127 abuts on a lower face M of the single top 121 so as to support the single top 121 and the end sheave 23.

Figure 4:
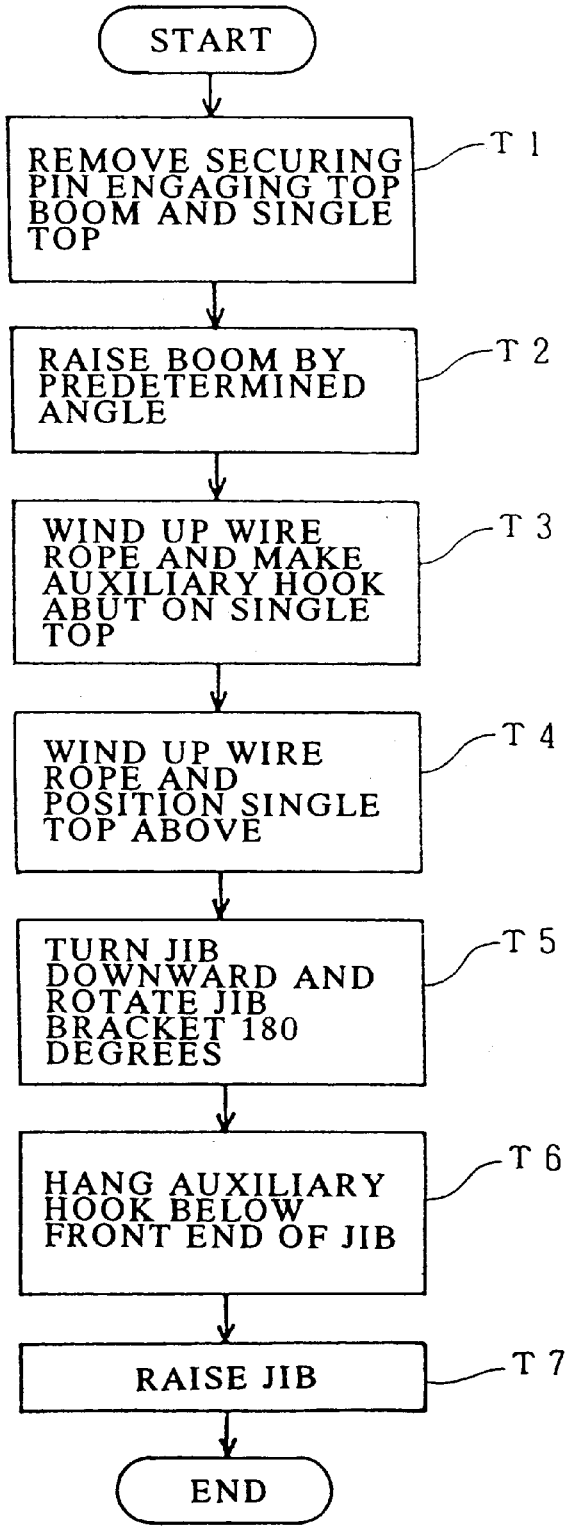
FIG. 4 is a flowchart describing a method for changing the wire rope in the first embodiment of the present invention.

Next, the operation of the above structure and a method for changing a wire rope at the time of extending and storing a jib will be explained in detail according to a process shown in FIG. 4 with reference to FIGS. 5 to 12. A step of the process is represented by "T". Namely, "step 1" is represented as "T1".

T1: The securing pins 126 are removed to release the engagement of the top boom 6 and the single top 121.

Figure 5:
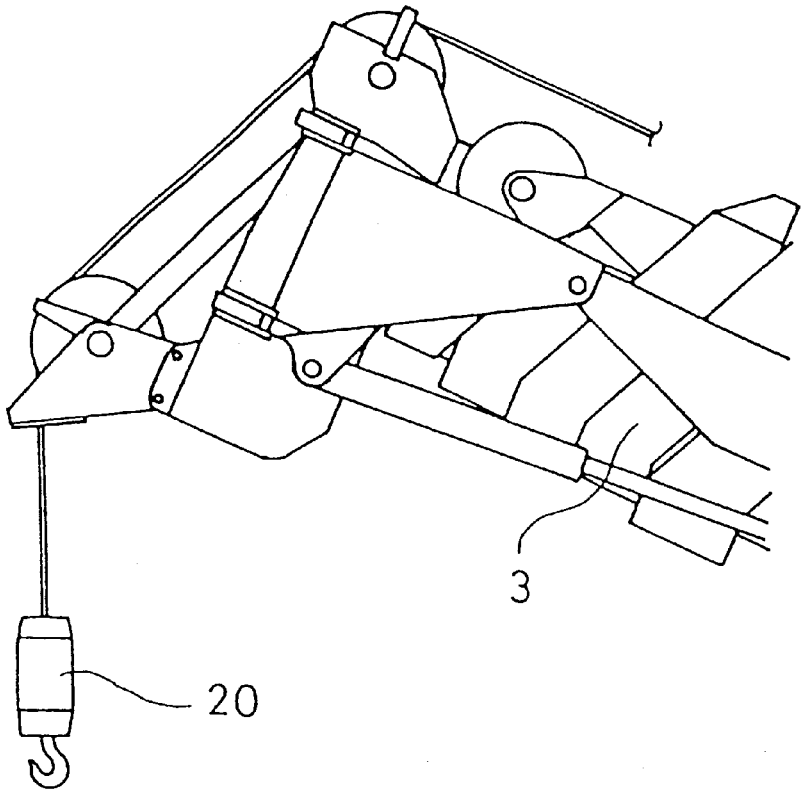
FIG. 5 is a drawing showing the state of a boom being raised by a predetermined angle and contracted and an auxiliary hook being hung, in the first embodiment of the present invention.

T2: As shown in FIG. 5, the boom 3 is raised to a predetermined angle and is contracted. The auxiliary hook 20 is in a hung state.

Figure 6:
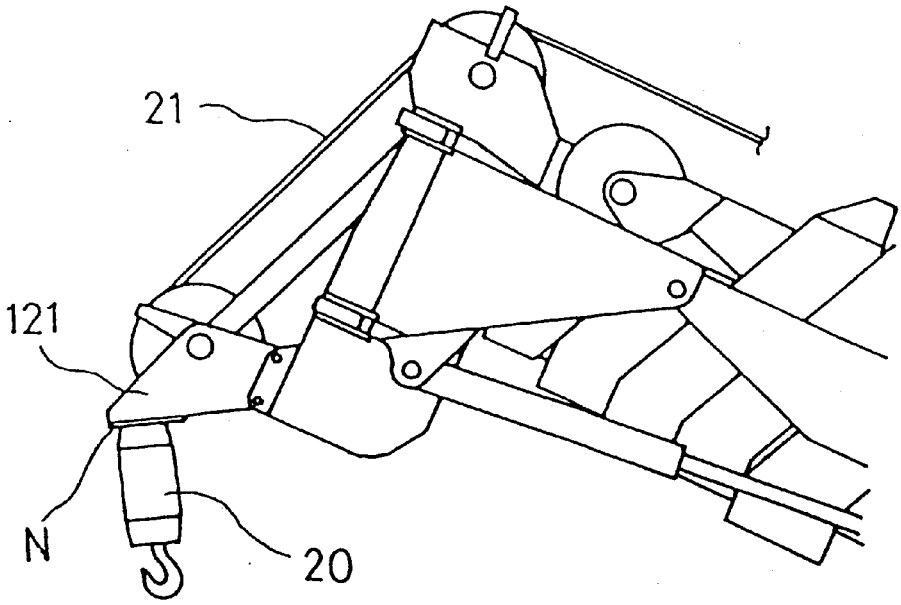
FIG. 6 is a drawing showing the state of the auxiliary hook abutting on the lower face of a single top in the first embodiment of the present invention.

T3: Next, as shown in FIG. 6, the wire rope 21 is wound up to make the auxiliary hook 20 abut on a lower face N of the single top 121.

Figure 7:
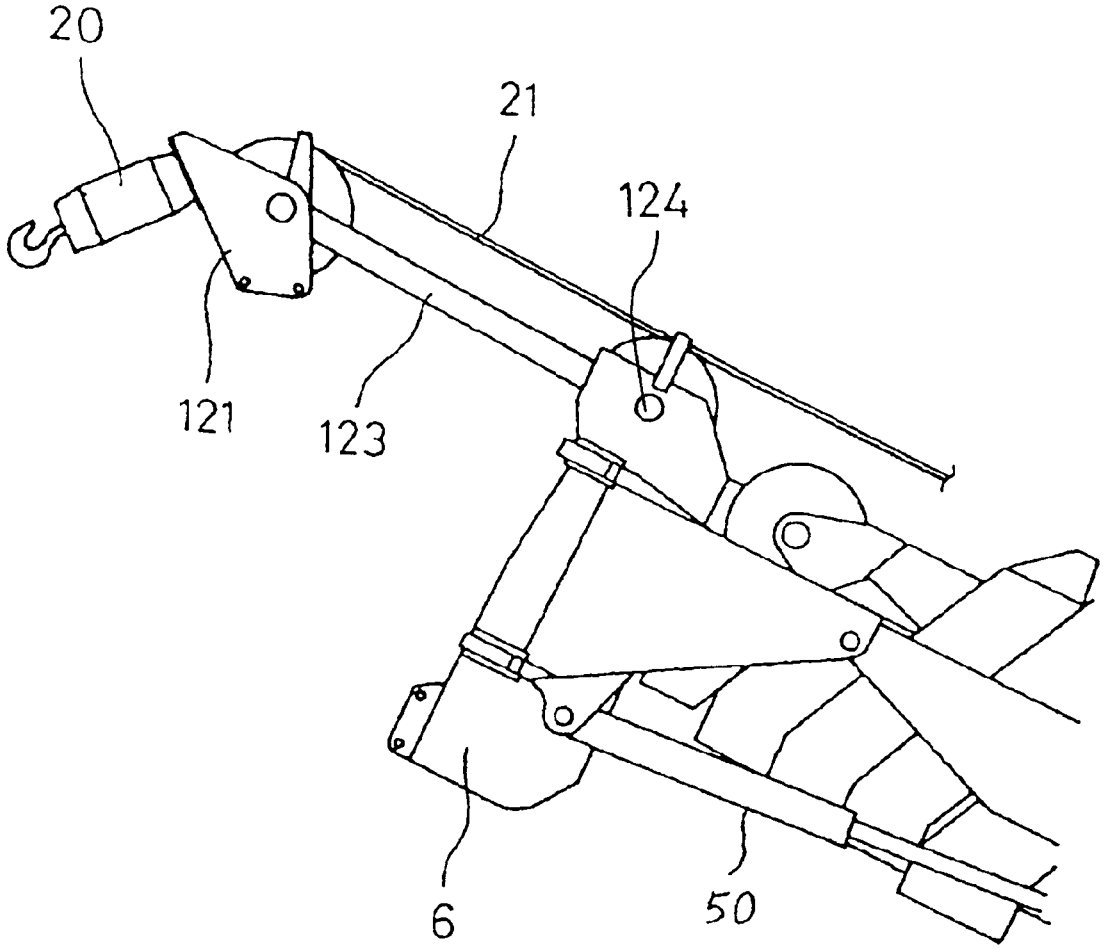
FIG. 7 is a drawing showing the state of the single top being raised in the first embodiment of the present invention.
Figure 8:
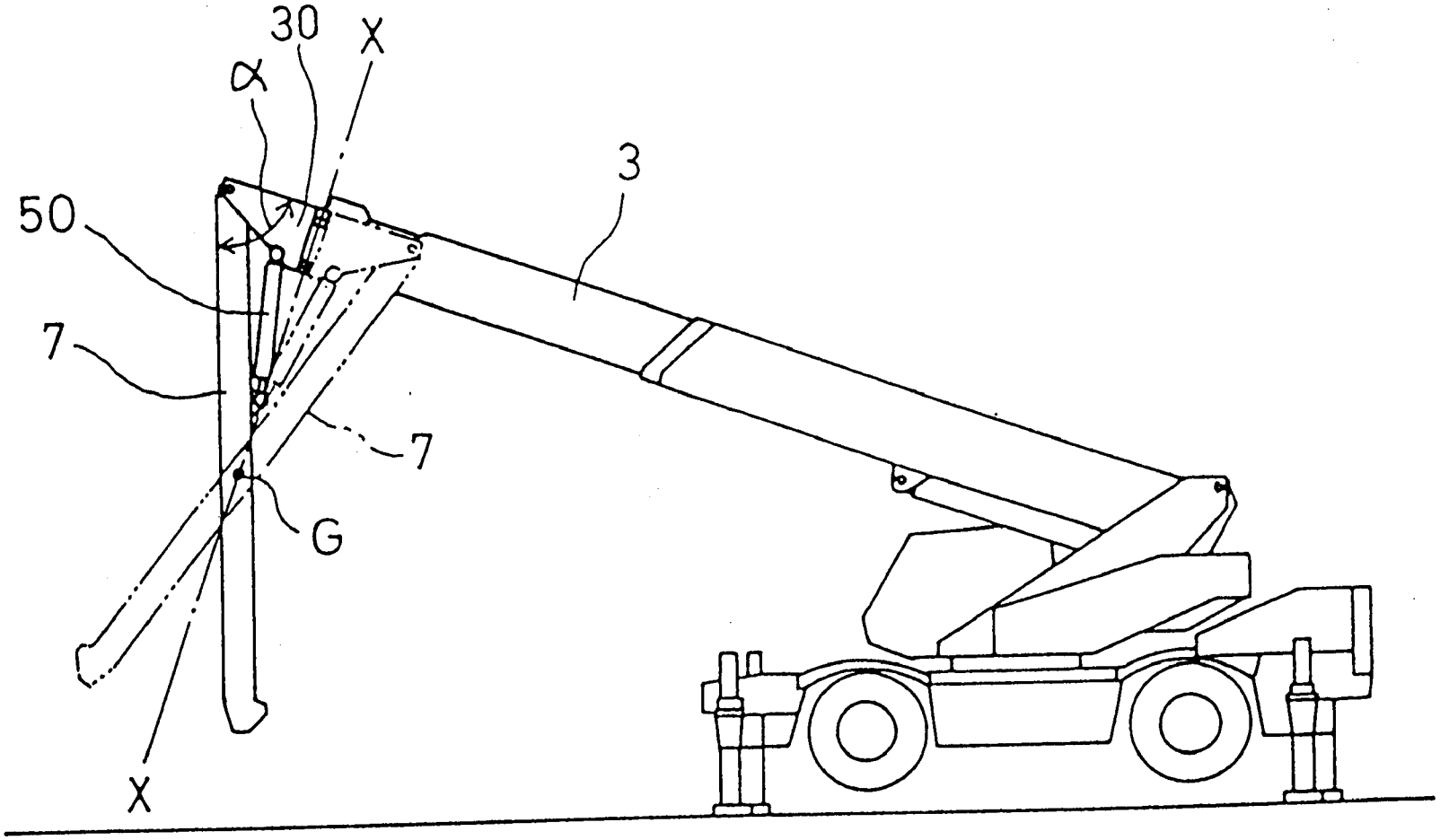
FIG. 8 is a drawing showing the state of the jib being pivoted downwardly and rotated in the first embodiment of the present invention.

T4: As shown in FIG. 7, the wire rope 21 is further wound up and the single top 121 and the single top link 123 are rotated about the axle 124 to position the single top 121 above and in front of the top boom 6.

T5: Next, a jib derricking cylinder 50 is contracted and the jib 7 is pivoted downwardly as shown with a chain double dashed line in FIG. 8. Subsequently, the rotary bracket 30 is rotated 180 degrees by a rotating device 80, which will be described below, so as to position the jib 7 at the full line position shown in FIG. 8. At this time, the jib 7 is nearly vertical to a ground surface. Accordingly, a relative angle $\alpha$ between the boom 3 and the jib 7 is not more than about 85 degrees. The jib derricking cylinder 50 has enough stroke to keep the jib 7 in such posture.

Figure 9:
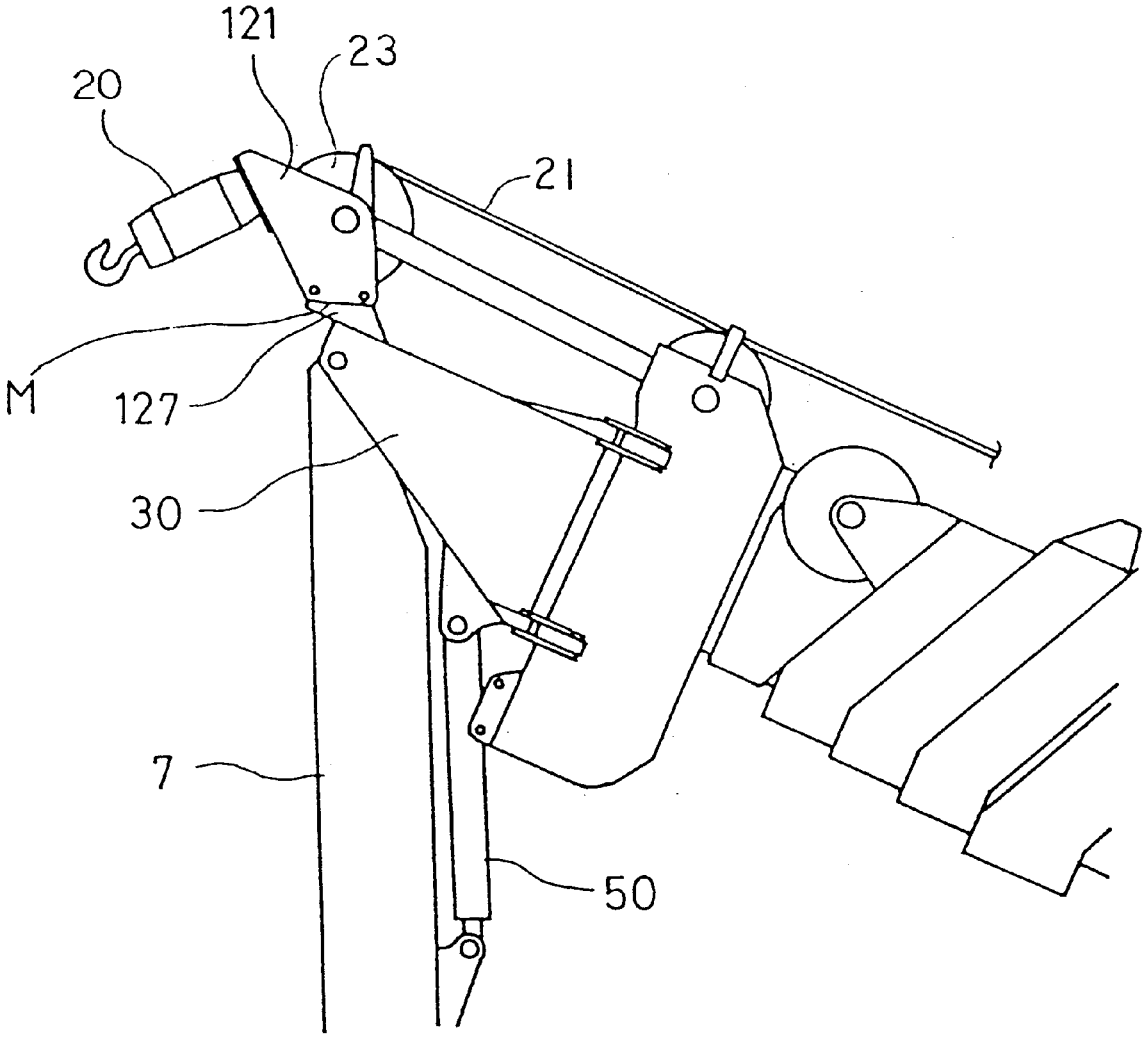
FIG. 9 is a drawing showing the state of a supporting base abutting on the lower face of the single top and the jib being extended in the first embodiment of the present invention.

The position of a center of gravity G of the jib 7 in this condition is nearly on the rotation center line X—X of the rotary bracket 30. Therefore, the rotational moment around the rotation center line X—X becomes smaller than the conventional one, so that the rotary bracket 30 can be rotated by a smaller force. When the rotary bracket 30 is rotated 180 degrees, the supporting base 127, provided on the front end of the rotary bracket 30, comes to the lower face M of the single top 121. When the supporting base 127 comes to the lower face M, if the auxiliary hook 20 is loosened, the supporting base 127 abuts on the lower face M of the single top 121 and supports the same, as shown in FIG. 9.

Figure 10:
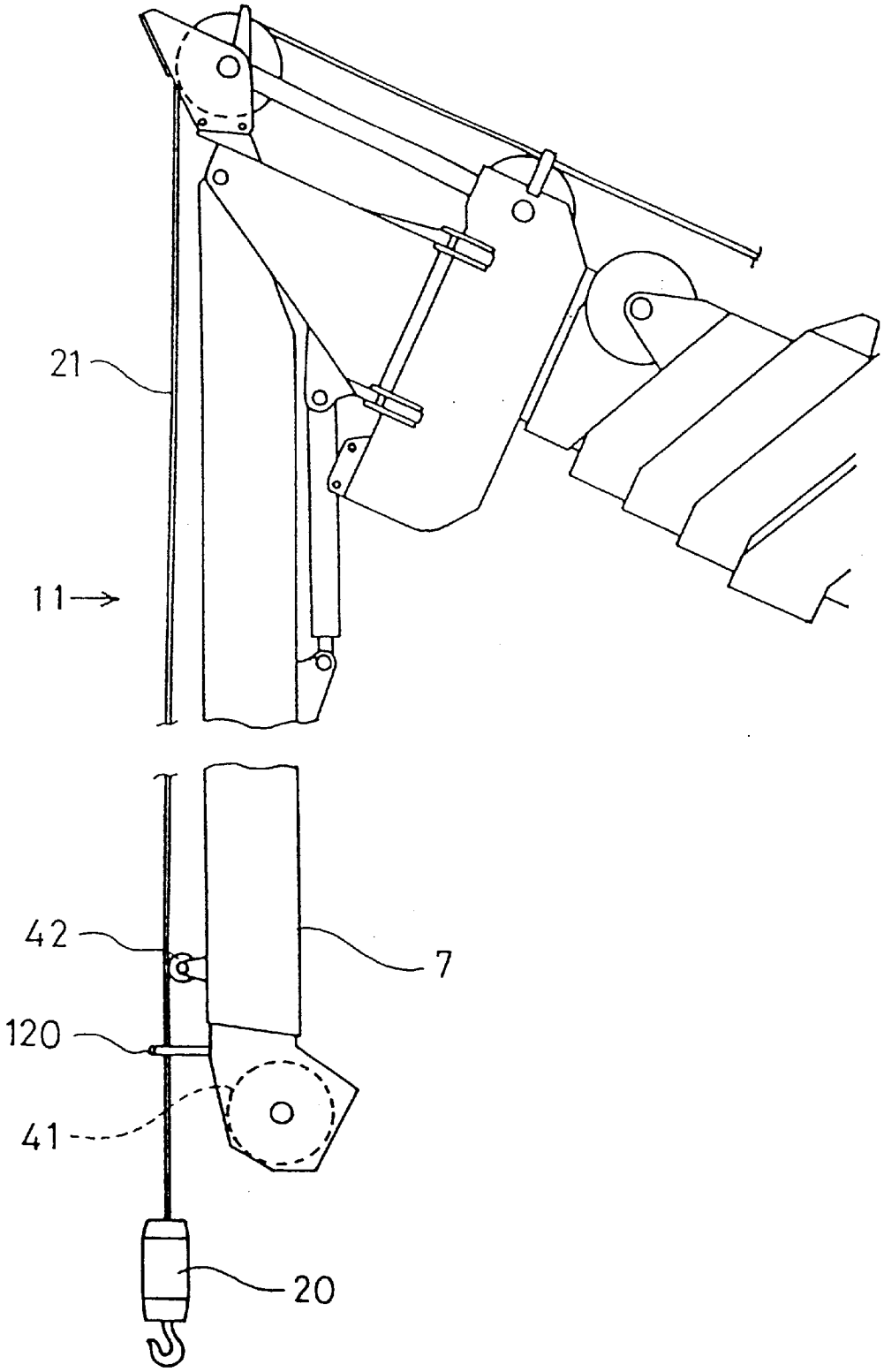
FIG. 10 is a drawing showing the state of the auxiliary hook being hung to a position below the front end of the jib.
Figure 11:
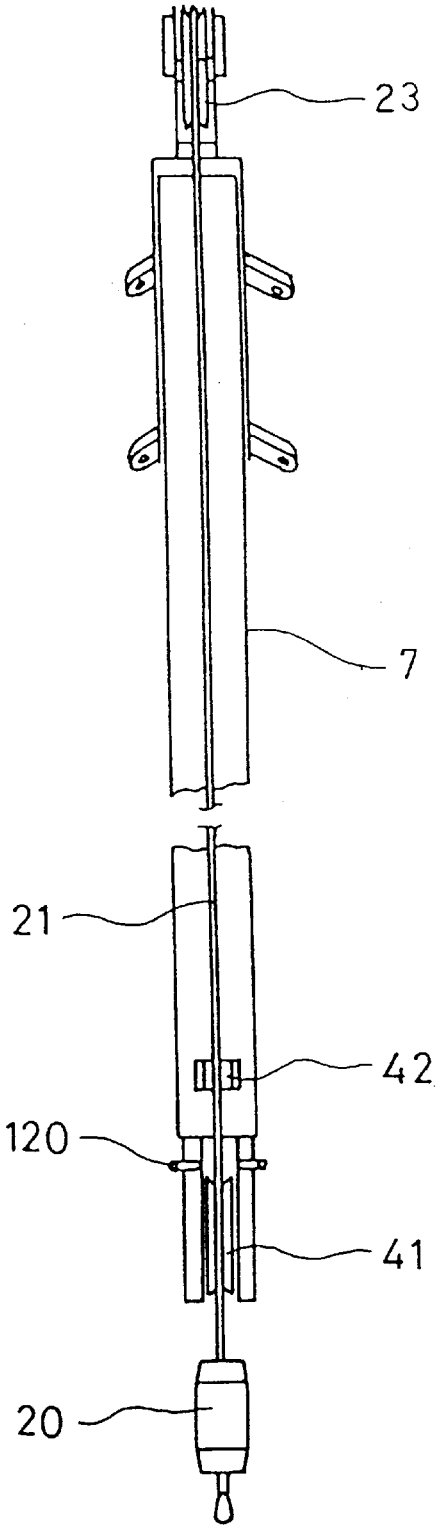
FIG. 11 is a front view, seen from an arrow 11 in FIG. 10, showing the state of the auxiliary hook being hung.

T6: Next, as shown in FIG. 10, the auxiliary hook 20 is hung at a position below the front end of the jib 7. At this time, as shown in FIG. 11 in which the jib 7 is seen from ahead, a center of the wire rope 21 and the centers of the load sheave 41 and the guide sheave 42 are at least substantially aligned with the wire rope 21 being disposed inside the wire rope guide 120. In this case, even if the center of the wire rope 21 is a little off to the side, it is guided by the wire rope guide 120 to align it with the centers of the load sheave 41 and the guide sheave 42.

Figure 12:
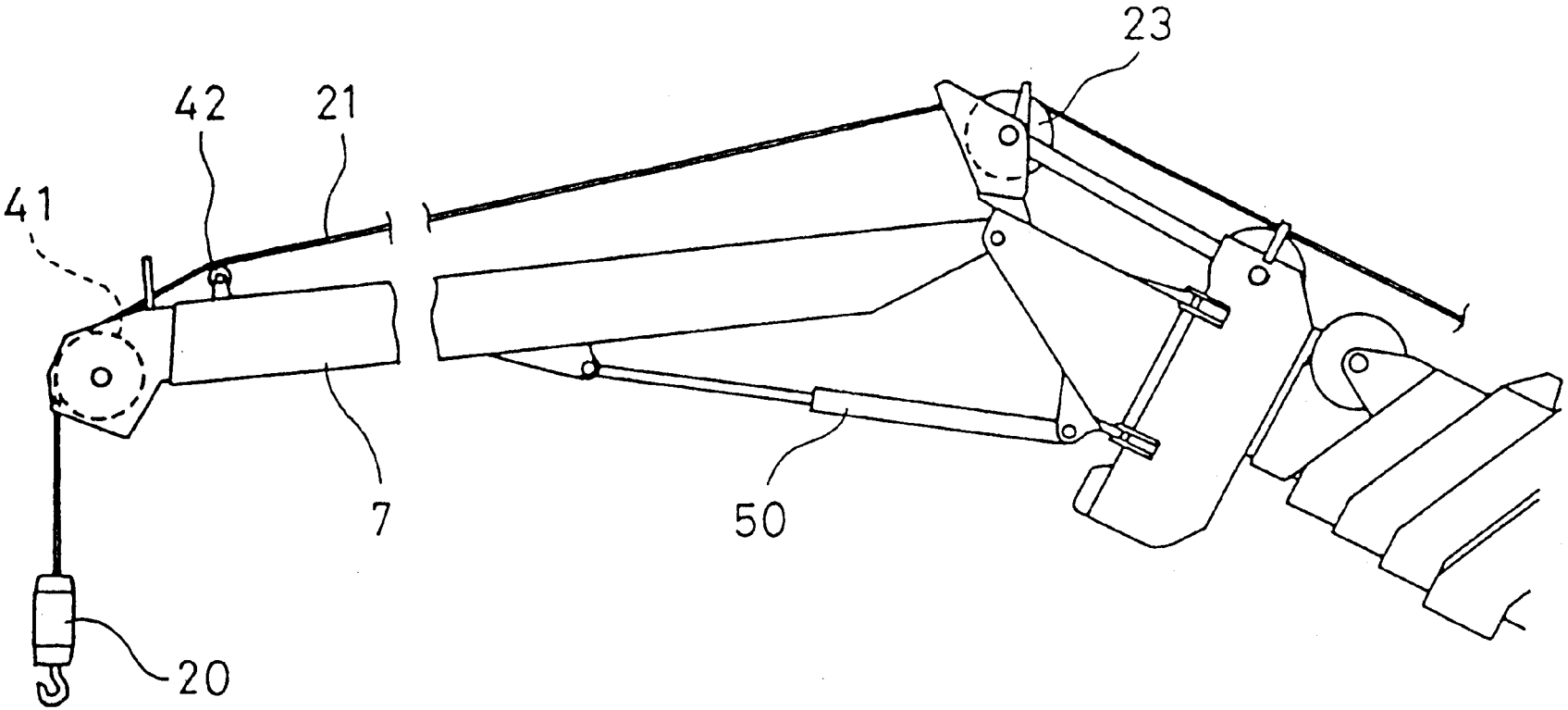
FIG. 12 is a drawing showing the state of the operation of changing the wire rope being completed in the first embodiment of the present invention.

T7: As shown in FIG. 12, the jib derricking cylinder 50 is extended to raise the jib 7. The wire rope 21 for the auxiliary hook 20 is automatically inserted into the load sheave 41 and the guide sheave 42, both of which are disposed at the front end of the jib 7.

Figure 13:
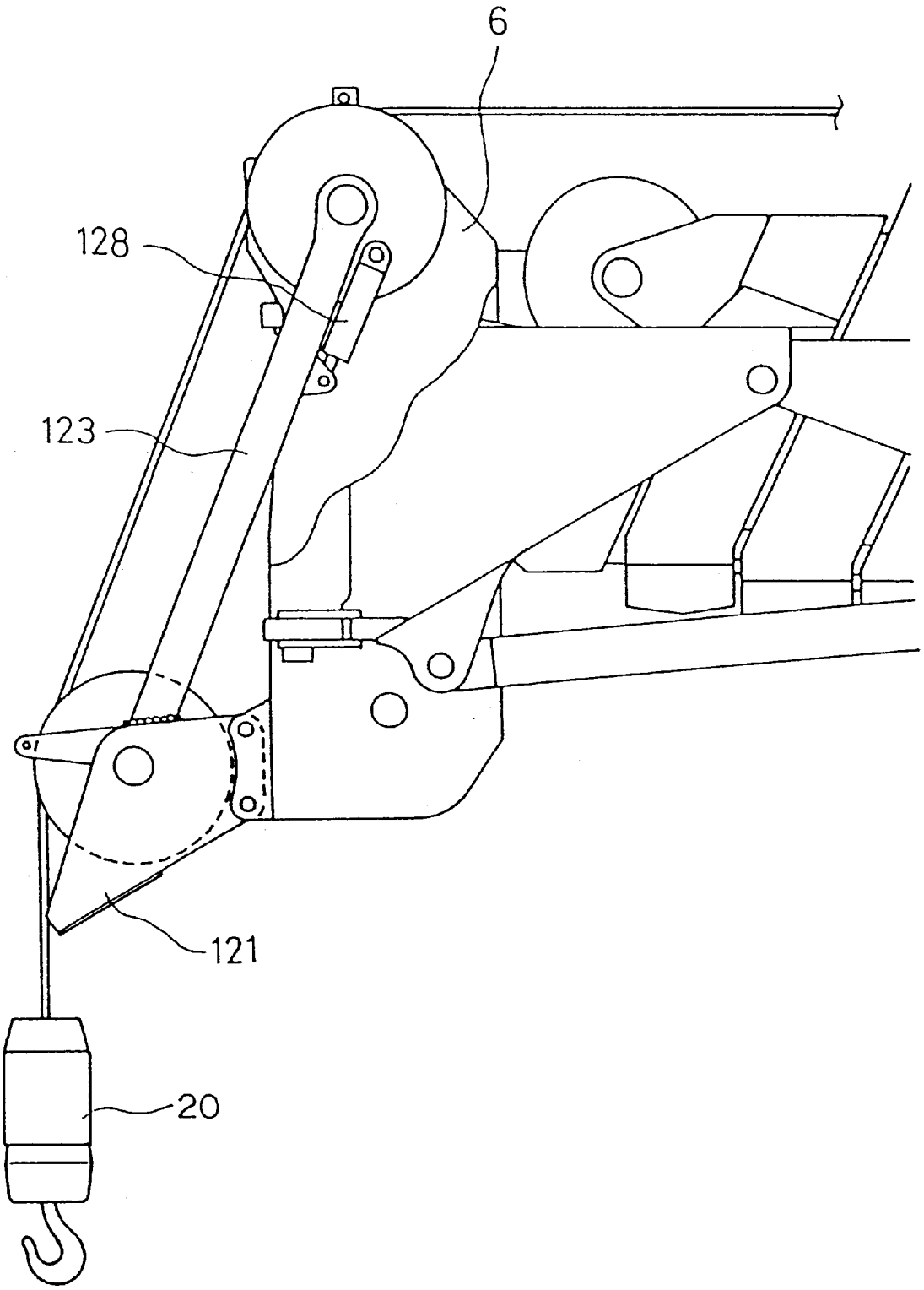
FIG. 13 is a side elevational view of the second embodiment of the device for changing the wire rope according to the present invention.

FIG. 13 shows the second embodiment of a device for changing the wire rope and its fundamental structure is the same as that of the first embodiment. Hence, only different parts will be described below. Specifically, the link 123 and the top boom 6 are connected with a hydraulic cylinder 128 or the like, and the single top 121 is rotated by extending and contracting the hydraulic cylinder 128 or the like.

As described above, if an operator removes the securing pins 126, which engage the top boom 6 and the single top 121 at first, the operator can thereafter be in the operator's seat and initiate the operation of raising, pivoting downwardly, or extending the jib 7, and the operation of the wire rope 21 for the auxiliary hook 20; thus, the wire rope 21 can be automatically changed. Accordingly, the operator does not need to carry the heavy auxiliary hook 20 or the wire rope 21 and does not need to insert the wire rope 21 into the guide sheave 42, whereby the operation of extending and storing the jib 7 can be easily and efficiently performed.

Figure 14:
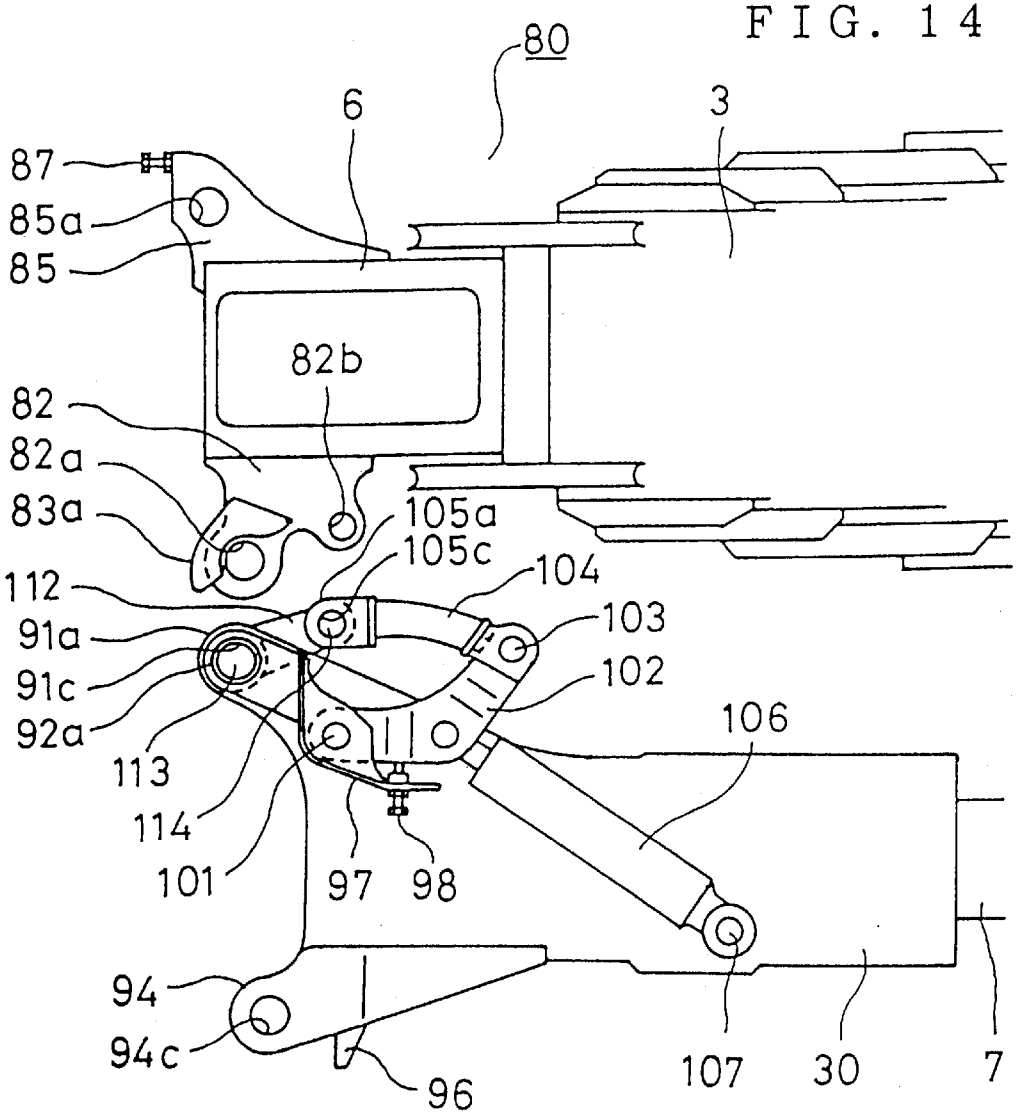
FIG. 14 is a plan view of a jib rotating device according to the present invention in the state that the jib is stored.
Figure 15:
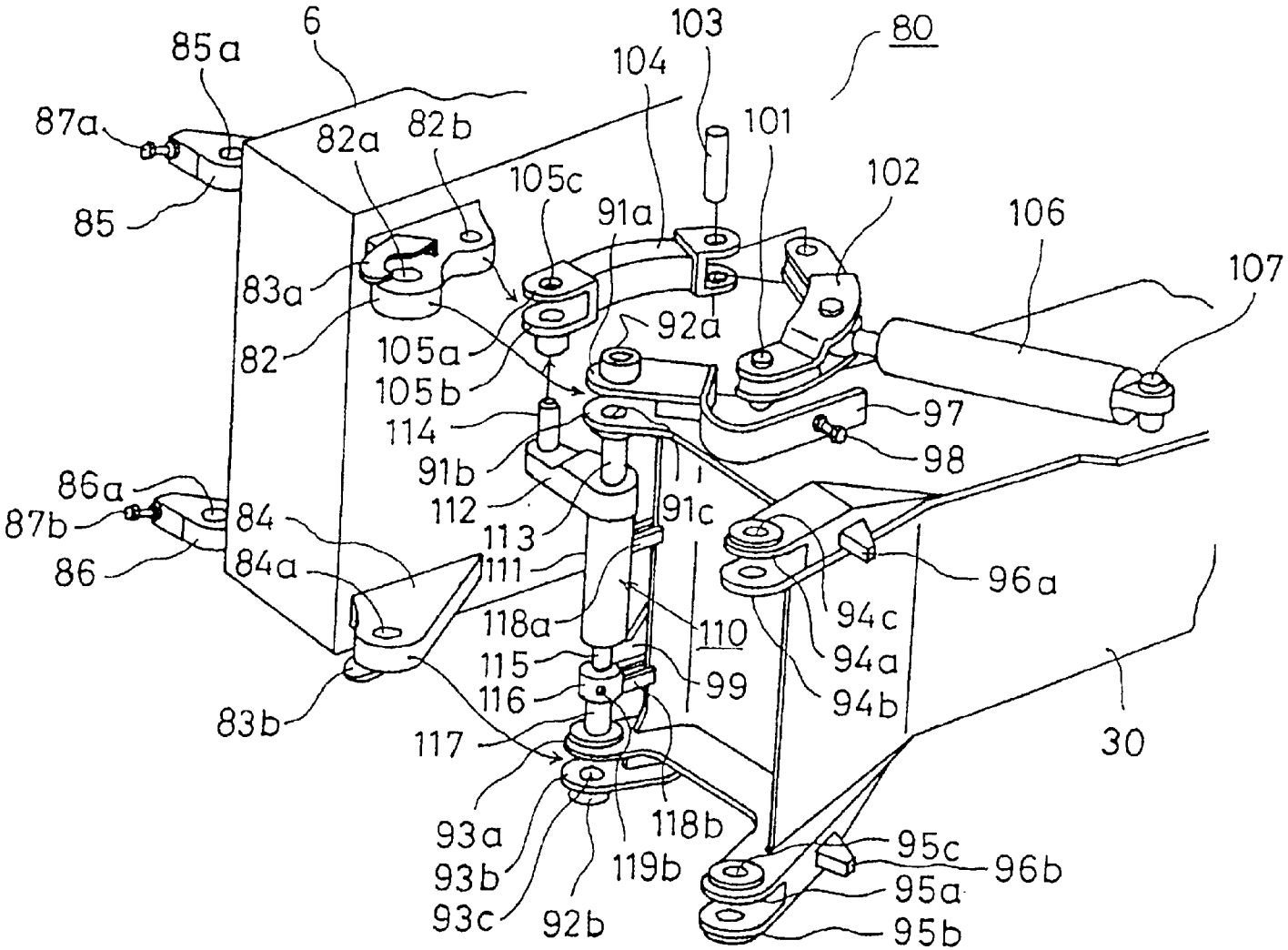
FIG. 15 is an explanatory view of component parts for the jib rotating device in FIG. 14 in the state that a cylinder lock is contracted.

Next, a rotating device in an apparatus for extending and storing a jib according to the present invention will be explained in detail. FIG. 14 is a plan view of the rotary bracket 30 and the top boom 6 of the boom 3, and shows the state in which the jib 7 is stored parallel to a side face of the boom 3. FIG. 15 is a perspective view of the jib bracket 30 and the top boom 6, and shows the structure of the rotating device 80. Incidentally, since in FIG. 14 hidden parts (for example, a bracket 84) omit their reference numerals and symbols (84), refer to also FIG. 15.

In FIGS., 14 and 15, a bracket 82, having a top boom first pin-hole 82*a* and a top boom second pin-hole 82*b*, is fixed to an upper portion of one side face of the front end of the top boom 6 in a lateral direction (the close side face of the front end of a boom when a jib and the boom are disposed parallel). A guide 83*a* is fixed on the upper face of the bracket 82. A bracket 84, having a top boom third pin-hole 84*a*, is fixed to a lower portion of the aforesaid one side face; and a guide 83*b* is fixed to a lower face of the bracket 84. As for the other side face of the front end of the top boom 6 (the far side face of the front end of the boom when the jib and the boom are disposed parallel), a bracket 85, having a top boom fourth pin-hole 85*a* and an adjusting bolt for the upper portion (a first positioning means) 87*a*, is fixed to an upper portion thereof; and a bracket 86, having a top boom fifth pin-hole 86*a* and an adjusting bolt for the lower portion (a first positioning means) 87*b*, is fixed to a lower portion thereof.

A fork end bracket 91*a*/91*b*, having a first through pin-hole 91*c* which is matched with the top boom first pin-hole 82*a* of the top boom 6, is provided at the upper portion of one side of the base end of the rotary bracket 30. A cylindrical member 92*a* is fixed on the upper face of the fork end bracket 91*a*. A fork end bracket 93*a*/93*b*, having a second through pin-hole 93*c* which is matched with the top boom third pin-hole 84*a* of the top boom 6, is provided at the lower portion of one side of the base end of the rotary bracket 30. A cylindrical member 92*b* is fixed to the lower face of the fork end bracket 93*b*.

As for the other side of the base end of the rotary bracket 30, a fork end bracket 94*a*/95*b*, having a third through pin-hole 94*c*, which is matched with the top boom fourth pin-hole 85*a* of the top boom 6, and a stopper 96*a*, for the upper portion are provided at an upper portion thereof; and a fork end bracket 95*a*/95*b*, having a fourth through pin-hole 95*c*, which is matched with the top boom fifth pin-hole 86*a* of the top boom 6, and a stopper 96*b* for the lower portion, are provided at a lower portion thereof.

One end of a first link 102 is rotatably attached to a first pin 101, which is fixed on the upper face of the rotary bracket 30, and one end of a second link 104 is connected to the other end of the first link 102 via a second pin 103. A fork end bracket 105*a*/105*b*, having a fifth through pin-hole 105*c*, is provided at the other end of the second link 104. A third pin 107, which is fixed on the upper face of the rotary bracket 30, and a central portion of the first link 102 are connected via a rotating cylinder 106. An adjusting bolt (a second positioning means) 98 is attached to a bracket 97 provided on the upper face of the rotary bracket 30.

Figure 17:
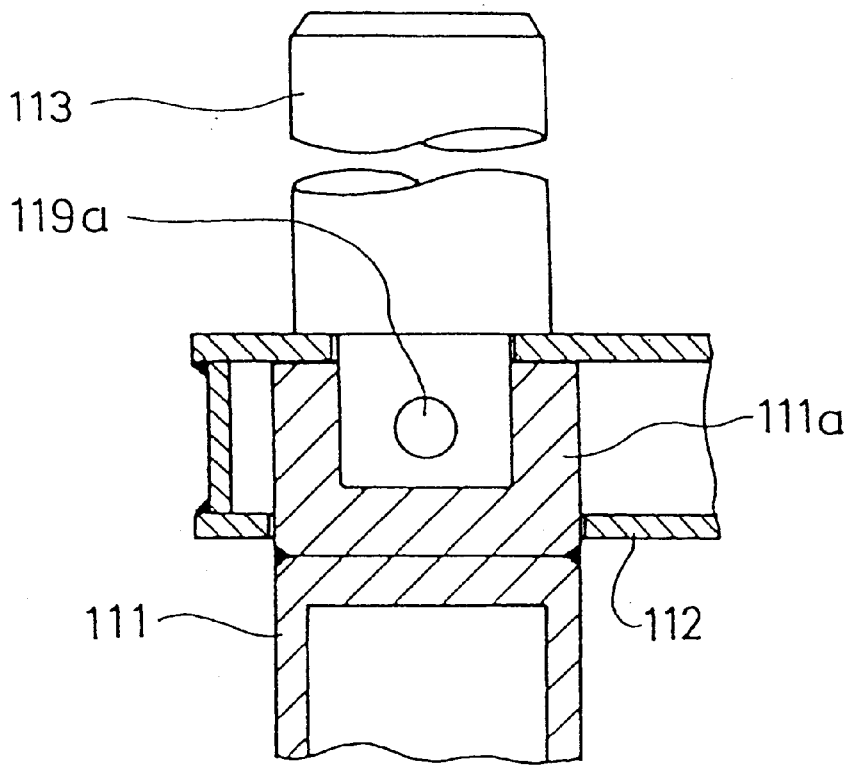
FIG. 17 is a sectional view of the rear end portion of the cylinder lock in FIG. 15.

In FIG. 17, a third link 112 is rotatably attached to a rear end portion 111*a* of a cylinder 111 of a cylinder lock 110. In the rear portion of the third link 112, a first connecting pin 113, which is engaged in the first through pin-hole 91*c* (See FIG. 15) of the rotary bracket 30, is inserted in the rear end portion 111*a* of the cylinder 111, and the first connecting pin 113 is fixed with a fourth pin 119*a*. The third link 112 is rotatably provided between the first connecting pin 113 and the rear portion 111*a* of the cylinder 111.

Figure 18:
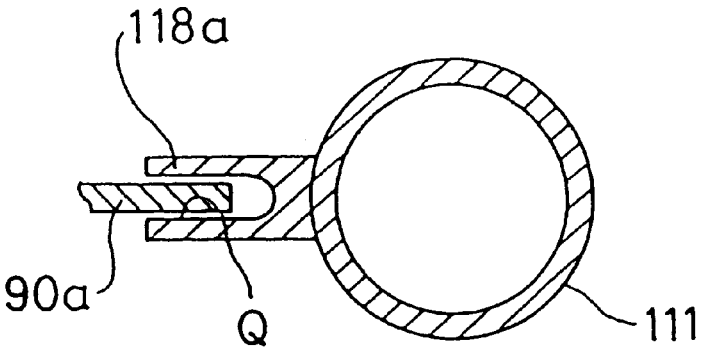
FIG. 18 is a sectional view of the cylinder lock taken along the line 18—18 in FIG. 16.

As shown in FIG. 18, a whirlstop member 118*a* is fixed to the outer periphery of the cylinder 111 in order to prevent the cylinder 111 from rotating with respect to the rotary bracket 30. A U-shaped slit Q is provided in the whirl-stop member 118*a*; and a plate member 90*a*, of the rotary bracket 30, is inserted into a recessed portion of the slit Q.

As shown in FIG. 15, a second connecting pin 114, which is engaged in the fifth through pin-hole 105*c* at the other end of the second link 104, is fixed on the front end of the third link 112. A flange portion 116 is provided at the front end of a piston rod 115 of the cylinder lock 110. A third connecting pin 117, which is engaged in the second through pin-hole 93*c* of the rotary bracket 30, is fixed to the front end of the flange portion 116 via a fifth pin 119*b*. In addition, a whirlstop member 118*b* is fixed to the outer periphery of the flange 116 in order to prevent the piston rod 115 from rotating with respect to the rotary bracket 30. Similarly to the above, a slit Q is also provided in the whirl-stop member 118*b*, and the plate member 90*a* of the rotary bracket 30 is inserted into a recessed portion of the slit Q.

When the cylinder lock 110 is contracted, the front end of the cylinder 111 abuts on the upper face of a stopper 99, fixed to the rotary bracket 30; and the front end of the first connecting pin 113, which is engaged in the fork end bracket 91*b* of the rotary bracket 30, does not penetrate to the first through pin-hole 91*c*. The front end of the second connecting pin 114 at the front end of the third link 112, which is engaged in the fork end bracket 105*b* of the second link 104, does not penetrate to the fifth through pin-hole 105*c*. The rear end of the flange portion 116 of the piston rod 115 abuts on the lower face of the stopper 99; and the front end of the third connecting pin 117, which is engaged in the fork end bracket 93*b* of the jib bracket 30, does not penetrate to the second through pin-hole 93*c*.

In such a state, the rotary bracket 30, the first link 102, the second link 104, and the third link 112 are connected to form a four-node link. The first link 102 is positioned on the rotary bracket 30 by the rotating cylinder 106. Therefore, even if the rotary bracket 30 is released from the top boom 6, the mutual positional relationship among the above links does not change. The position of the four-node link is determined by a cylinder stroke (a distance between cylinder pins) of the rotating cylinder 106, and the position of the first link 102 is adjusted by adjusting the cylinder stroke with the adjusting bolt 98. Thus, the positions of the top boom first pin-hole 82*a* and the top boom second pin-hole 82*b* can be matched with the positions of the first connecting pin 113 and the second connecting pin 114.

Figure 16:
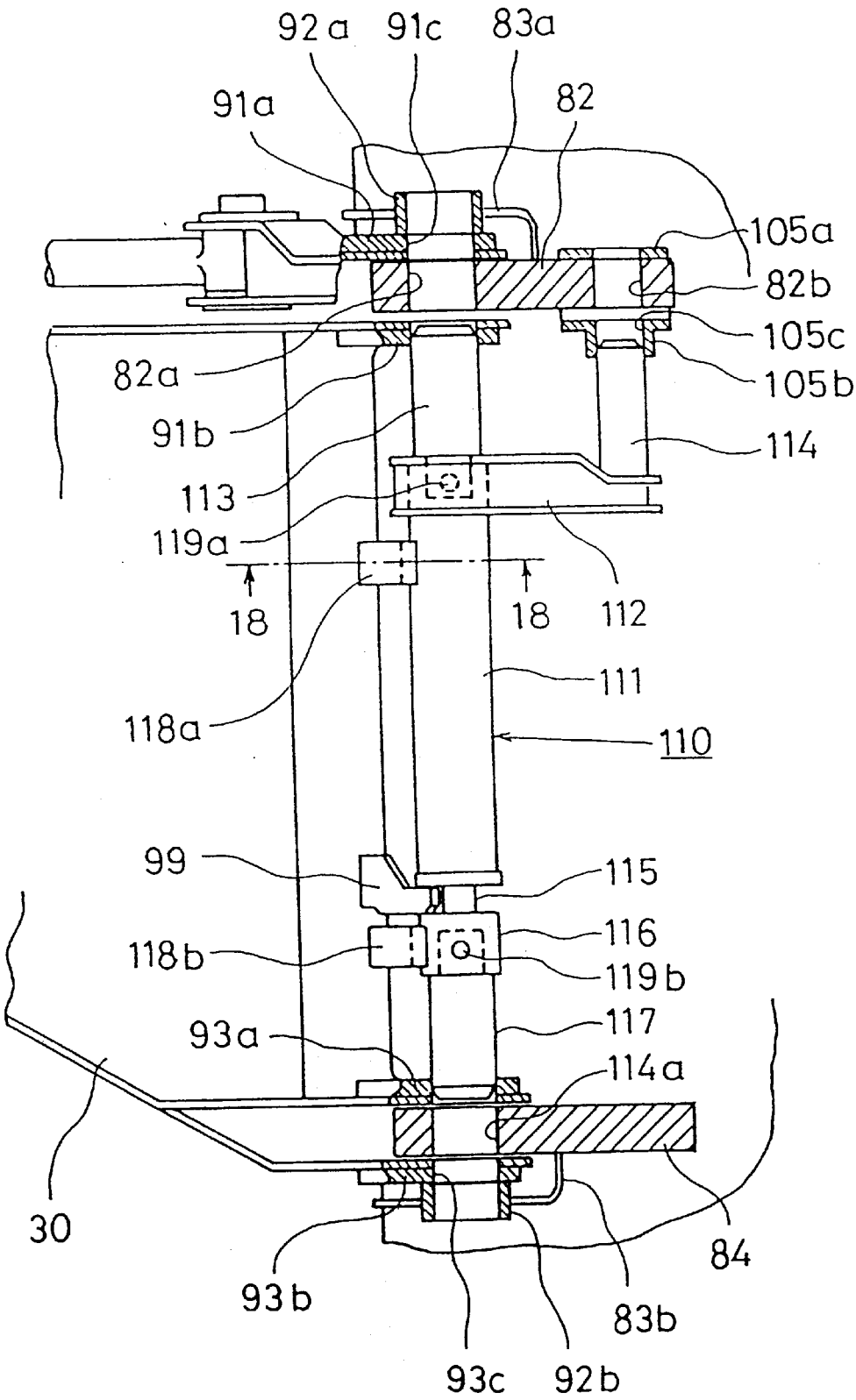
FIG. 16 is a sectional view of the cylinder lock in FIG. 15 in a contracted state.
Figure 19:
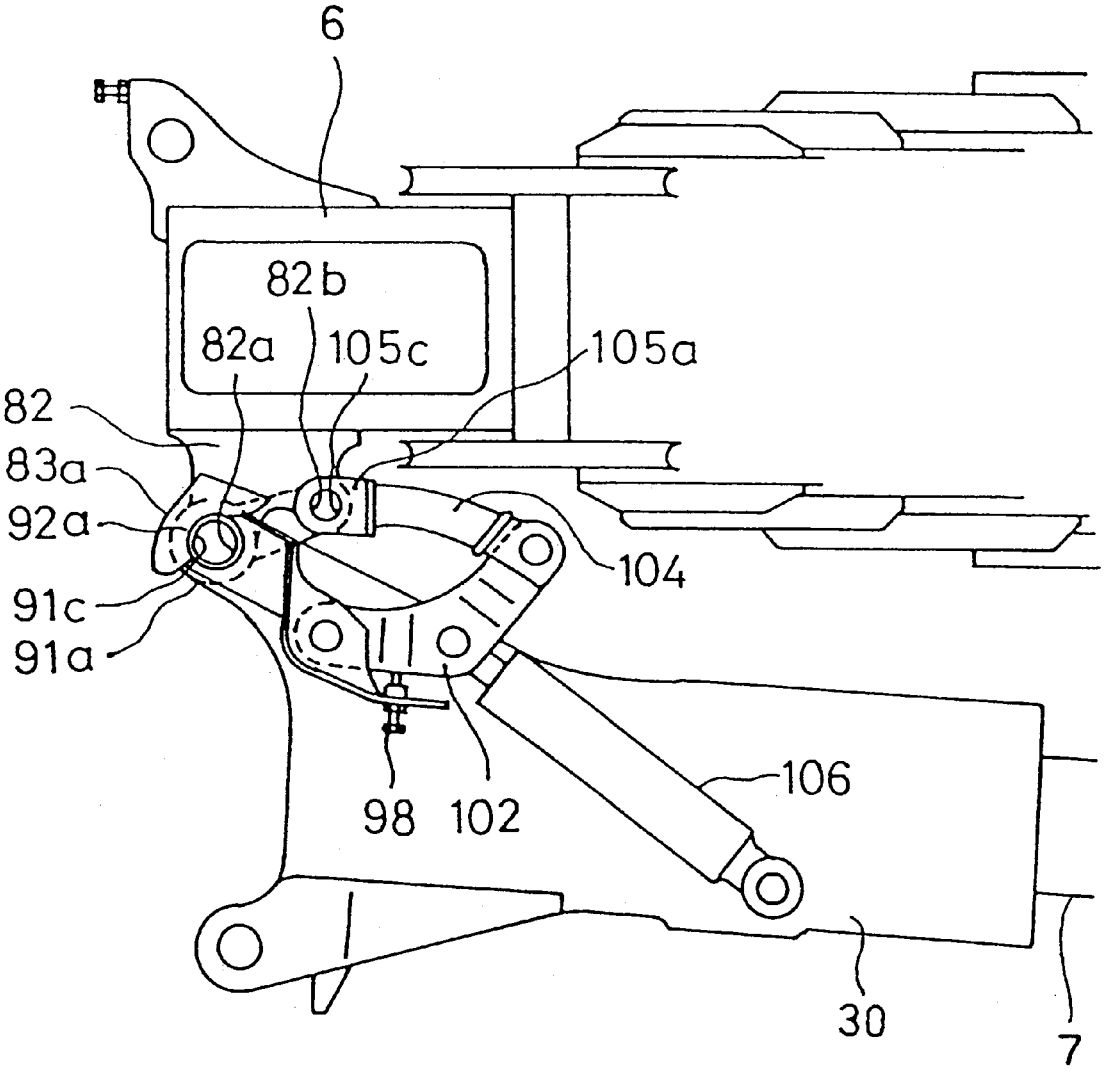
FIG. 19 is a plan view of the jib rotating device according to the present invention in the state that the jib is swung out.

Next, the operation of the aforesaid rotating device 80 will be described. When the jib 7 is extended in relation to the top boom 6, the jib 7 is swung outwardly by a side holding device (not shown) in a lateral direction. FIG. 19 shows the relationship between the rotary bracket 30 and the top boom 6 in the state that the jib is swung outwardly. FIG. 16 shows a sectional view of the cylinder lock 110 in the above state. Incidentally, since hidden parts omit their reference numerals and symbols in FIG. 19, refer also to FIG. 15.

Specifically, the brackets 82 and 84 of the top boom 6 are respectively inserted in the fork end brackets 91*a*/91*b* and 93*a*/93*b* of the jib bracket 30. The top boom first pin-hole 82*a* and the top boom third pin-hole 84*a* are respectively matched with the first through pin-hole 91*c* and the second through pin-hole 93*c*. When their positions do not coincide with each other, the guide 83*a*, provided on the bracket 82, and the guide 83*b*, provided under the bracket 84, guide the cylindrical member 92*a*, provided on the fork end bracket 91*a*, and the cylindrical member 92*b*, provided under the fork end bracket 93*b*, to the predetermined positions. At the same time, the bracket 82 of the top boom 6 is inserted in the fork end bracket 105*a*/105*b* of the second link 104.

When the rotating cylinder 106 is contracted, the first link 102 abuts on the adjusting bolt 98. In the abutting state, the length of the adjusting bolt 98 is adjusted so that the fifth through pin-hole 105*c* of the second link 104 and the top boom second pin-hole 82*b* will be matched. Hence, the top boom second pin-hole 82*b* and the fifth through pin-hole 105*c* are aligned.

Figure 20:
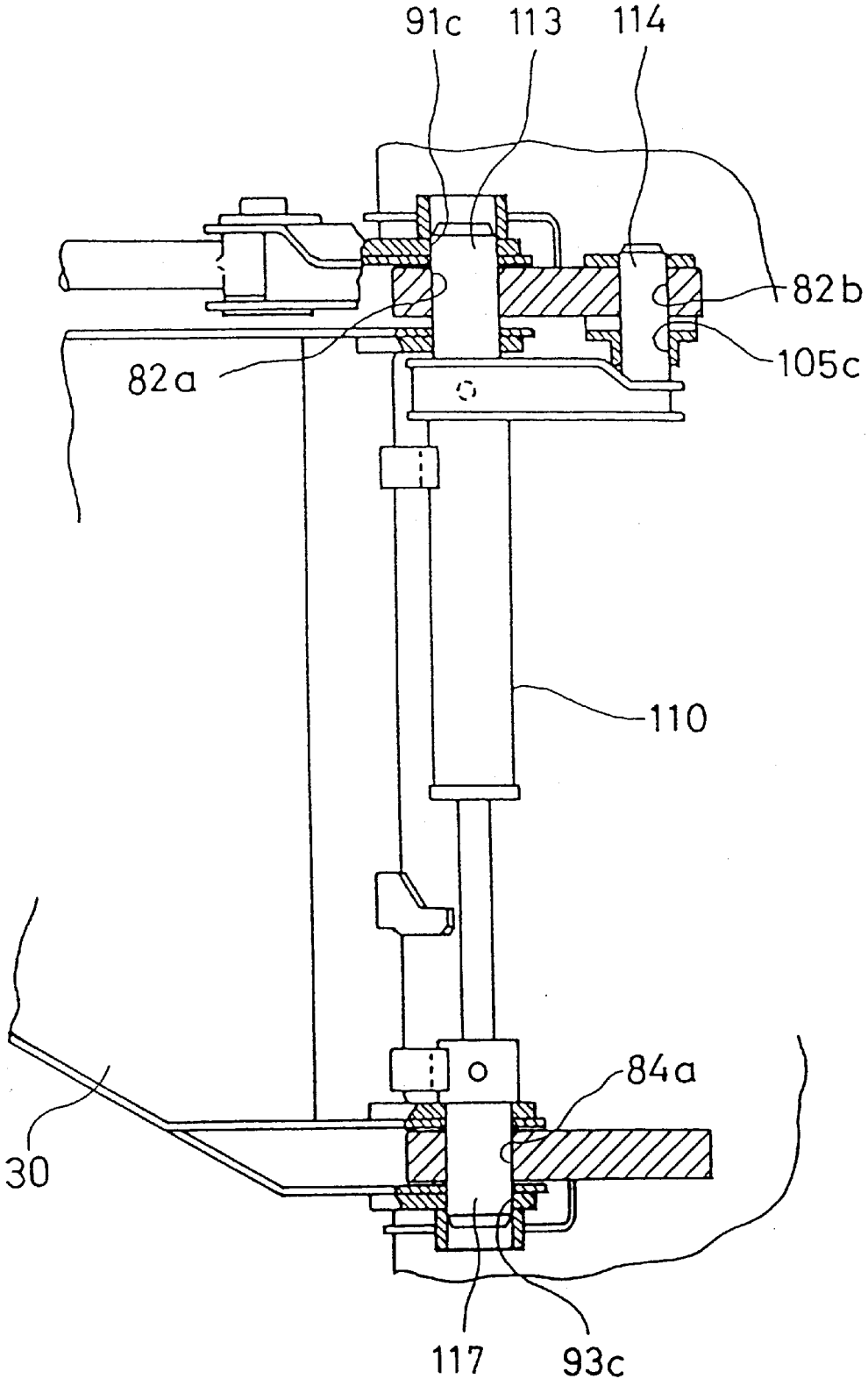
FIG. 20 is a sectional view of the cylinder lock in FIG. 16 in an extended state.

Next, as shown in FIG. 20, the cylinder lock 110 is extended to make the first connecting pin 113 penetrate the top boom first pin-hole 82*a* and the first through pin-hole 91*c*. At the same time, the extending of the cylinder lock 110 causes the second connecting pin 114 to penetrate the top boom second pin-hole 82*b* and the fifth through pin-hole 105*c*. Moreover, the extending of the cylinder lock 110 causes the third connecting pin 117 to penetrate the top boom third pin-hole 84*a* and the second through pin-hole 93*c*. One side of the connecting bracket 30 and one side of the top boom 6 are connected by the aforesaid penetration.

Figure 21:
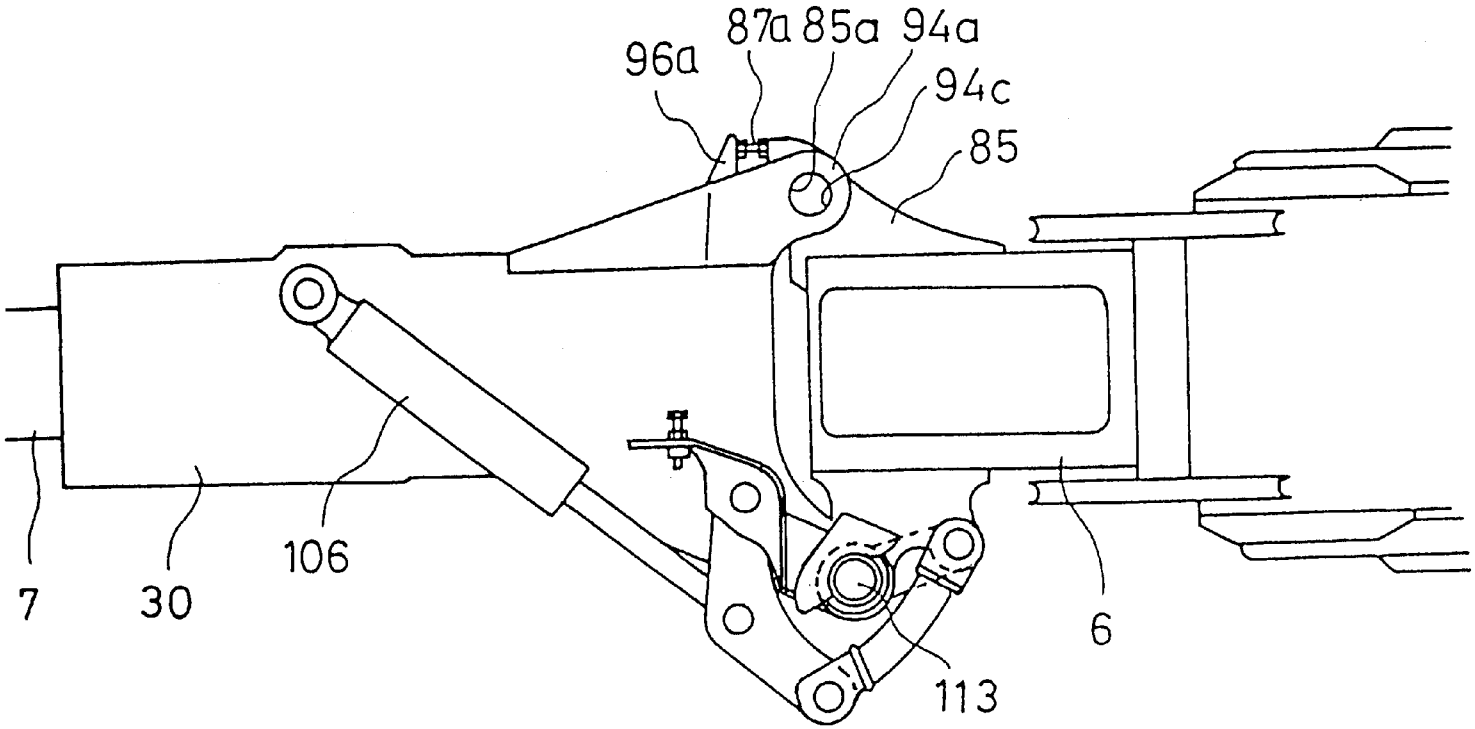
FIG. 21 is a plan view showing the state of a rotating cylinder being extended to extend a jib as against the state in FIG. 19.

Next, when the rotating cylinder 106 is extended, the rotary bracket 30 is rotated on the first connecting pin 113, as shown in FIG. 21. Incidentally, since hidden parts omit their reference numerals and symbols in FIG. 21, refer also to FIG. 15.

The brackets 85 and 86 on the other side of the top boom 6 are respectively inserted in the fork end bracket 94*a*/94*b* and the fork end bracket 95*a*/95*b* by the aforesaid rotation. The stoppers 96*a* and 96*b* abut on the adjusting bolt 87*a* for the upper portion and the adjusting bolt 87*b* for the lower portion, which are respectively provided at the brackets 85 and 86. At this time, the lengths of the adjusting bolt for the upper portion 87*a* and the adjusting bolt for the lower portion 87*b* are adjusted so that the top boom fourth pin-hole 85*a* will be aligned with the third through pin-hole 94*c* and the top boom fifth pin-hole 86*a* will be aligned with the fourth through pin-hole 95*c*, respectively. Next, the other side of the top boom 6 and the other side of the rotary bracket 30 are locked by a locking device (not shown) and the extension of the jib 7 is completed.

As shown in FIGS. 15 and 16, the cylinder lock 110 is provided with a hydraulic hose (not shown). Therefore, the whirl-stop members 118*a* and 118*b* are attached to the cylinder lock 110 so as not to rotate the cylinder lock 110 in relation to the rotary bracket 30. Thus, when the jib 7 rotates, the cylinder lock 110 rotates around the top boom first pin-hole 82*a* similarly to the rotary bracket 30. The position of the third link 112 does not move relative to the top boom 6, even while the jib 7 is rotating. For the aforesaid reasons, the third link 112 is rotatably attached to the cylinder lock 110, but the third link 112 can be fixed to the cylinder lock 110 as another way, if the cylinder lock 110 can rotate in relation to the rotary bracket 30. Here, the hydraulic hose needs to be taken out from the top boom 6.

Since the rotating device 80 for the rotary bracket 30 is structured as described above, when the jib 7 is swung outwardly in the state that the rotating cylinder 106 is contracted, the positions of the top boom first pin-hole 82*a* on one side of the top boom 6 and the first through pin-hole 91*c* on one side of the rotary bracket 30 and the positions of the top boom second pin-hole 82*b* of the top boom 6 and the fifth through pin-hole 105*c* at the front end of the second link 104 are automatically matched. After the rotating cylinder 106 is extended and the rotary bracket 30 is rotated 180 degrees, the positions of the top boom fourth pin-hole 85*a* on the other side of the top boom 6 and the third through pin-hole 94*c* on the other side of the rotary bracket 30 are automatically matched. Accordingly, the operation of extending the jib 7 can be easily conducted.

Figure 22:
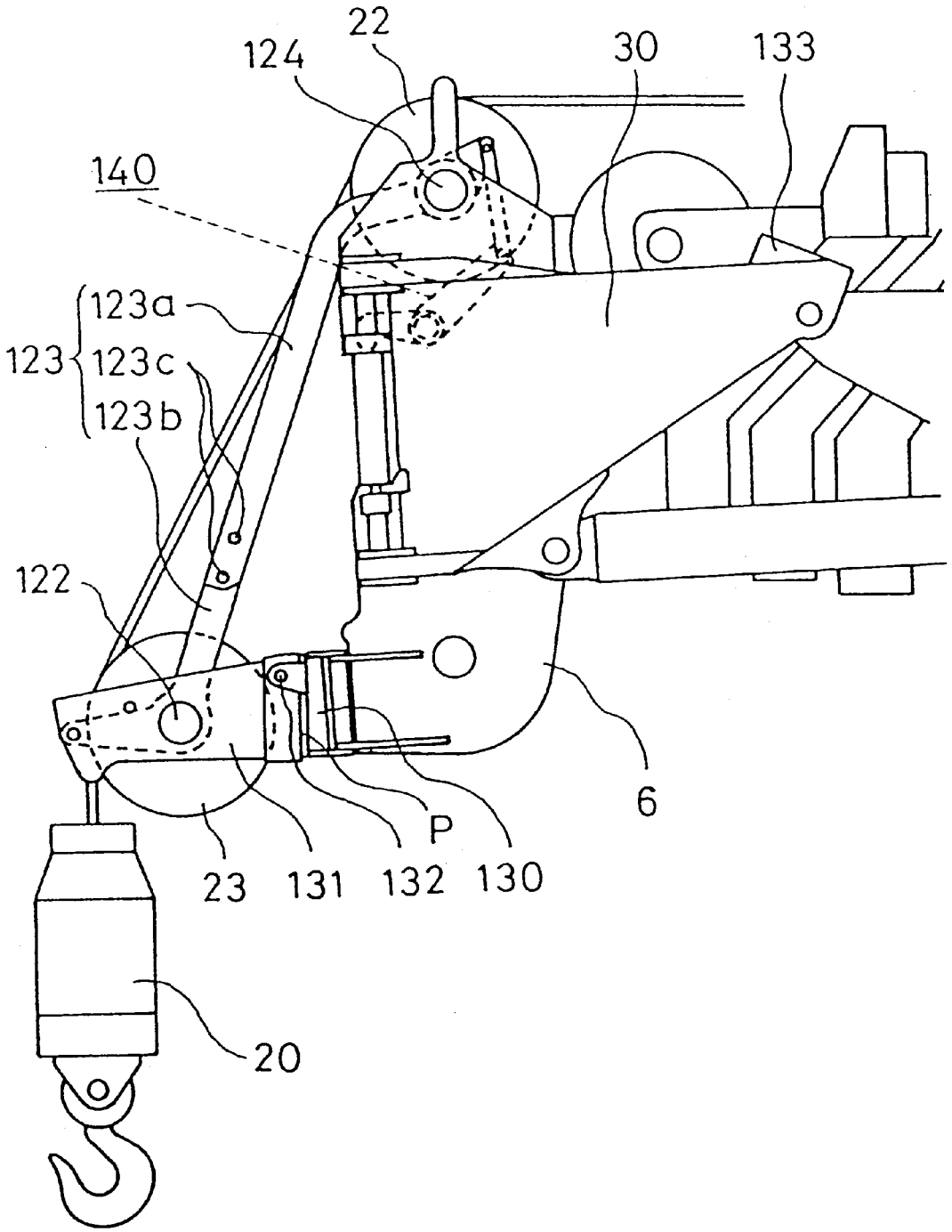
FIG. 22 is a side elevational view of the third embodiment of the device for changing the wire rope according to the present invention.

FIG. 22 shows the third embodiment of the device for changing the wire rope. A single top 131 is detachably attached with a securing pin 132 to a bracket 130, which is attached to the front lower end of the top boom 6. The end sheave 23 is attached to the single top 131 with the end sheave axle 122. One end of the single top link 123 is attached to the end sheave axle 122. The other end of the single top link 123 is rotatably attached to the guide sheave axle 124 of the guide sheave 22 which is provided on the upper portion of the top boom 6. The single top link 123 comprises of an upper link 123*a* and a lower link 123*b*, which are detachably connected to each other via plural connecting pins 123*c*. A link rotation drive unit 140, for rotating the single top link 123, is provided at the front end portion of the top boom 6. In this condition, the wire rope 21 can be positioned round the end sheave 23 at the front end of the top boom 6, and loads can be lifted with the auxiliary hook 20.

Fixed on the front end upper portion of the right side of the rotary bracket 30, shown in the illustration, is a supporting base 133, which abuts on a lower face P of the single top 131 and supports the single top 131 and the end sheave 23 when the single top 131 is raised above and in front of the top boom 6 and the rotary bracket 30 is rotated 180 degrees in the forward direction of the top boom 6.

Figure 23:
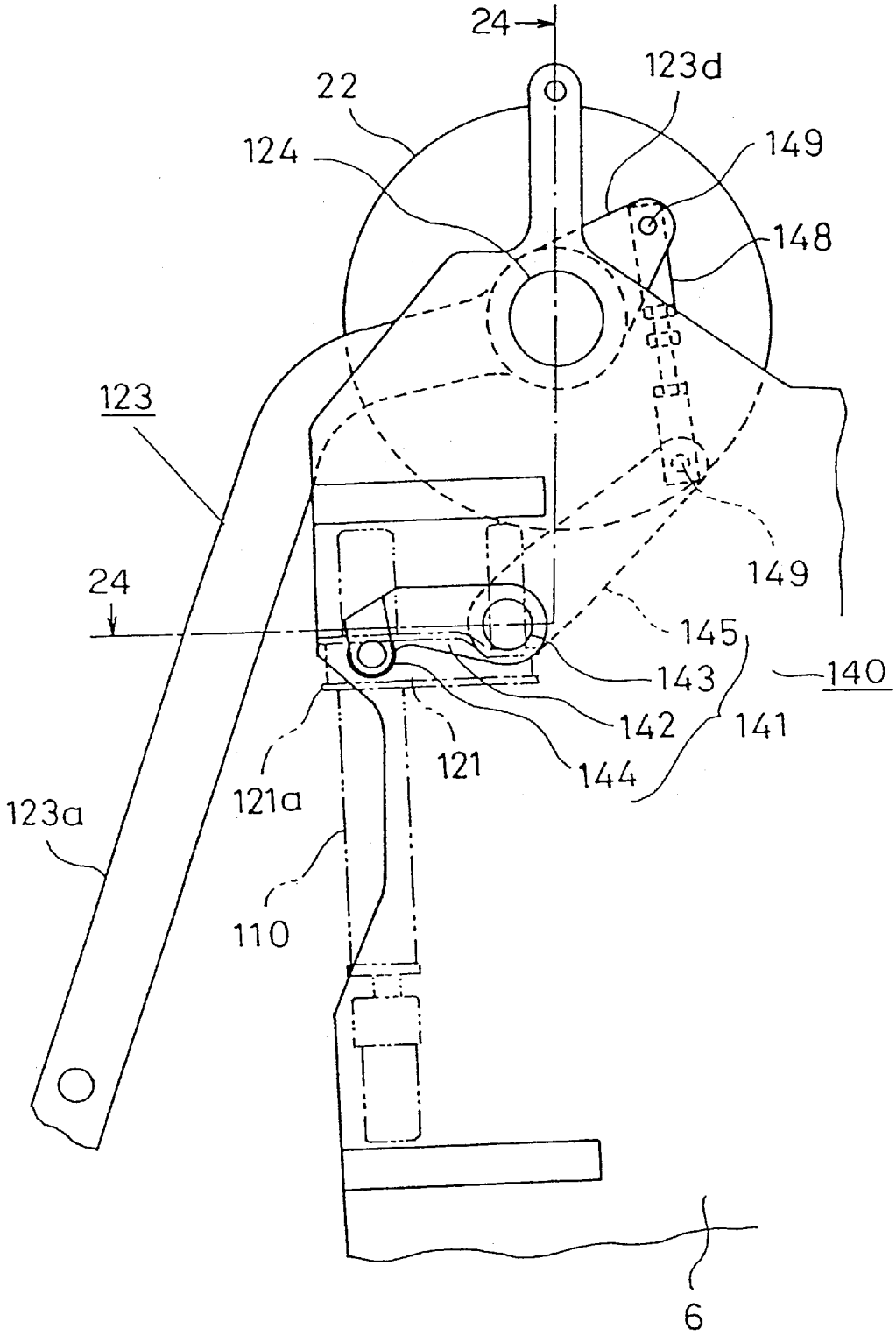
FIG. 23 is a side elevational view of a link rotation drive unit in the third embodiment of the present invention.
Figure 24:
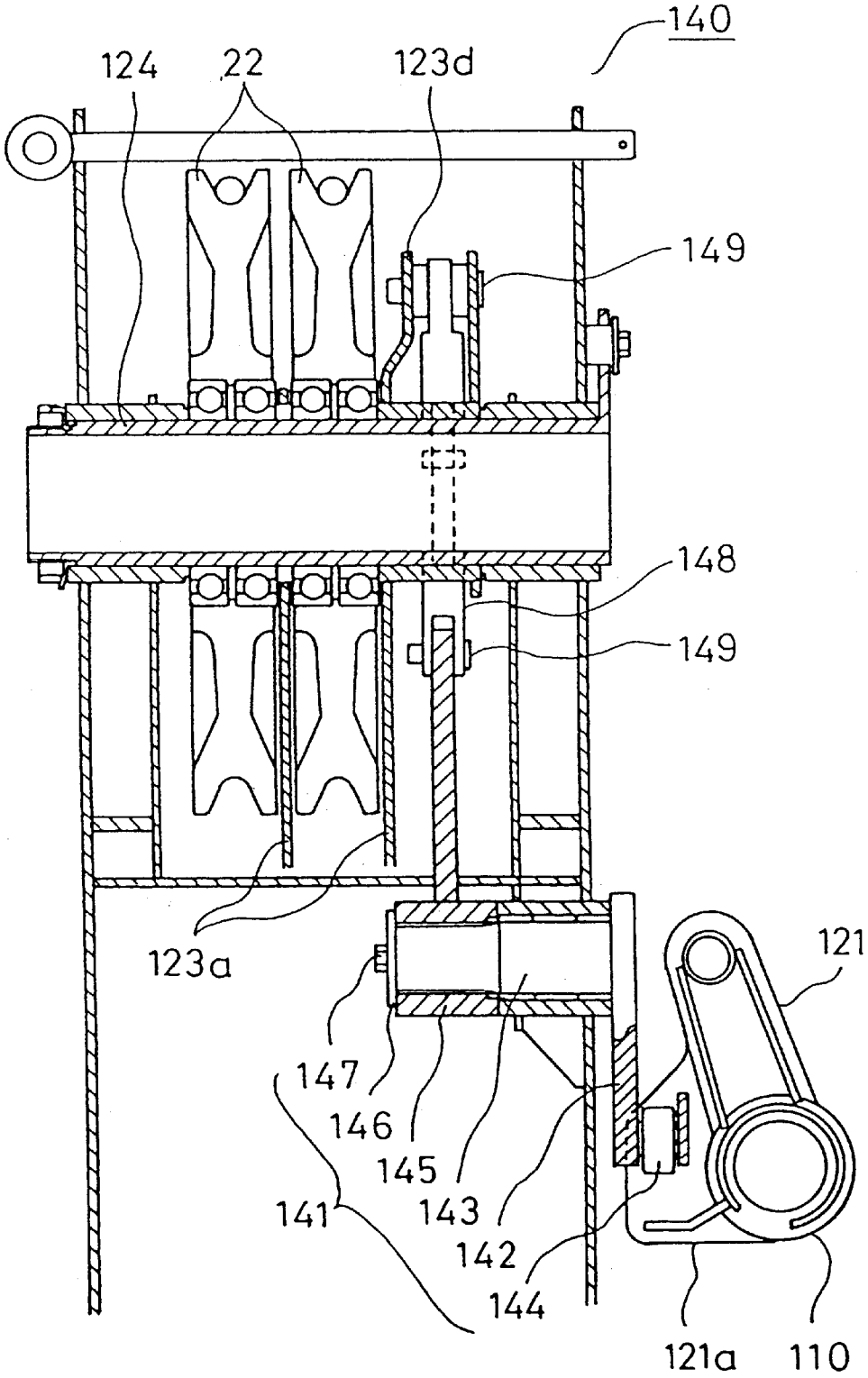
FIG. 24 is a sectional view taken along the 24—24 line in FIG. 23.
Figure 25:
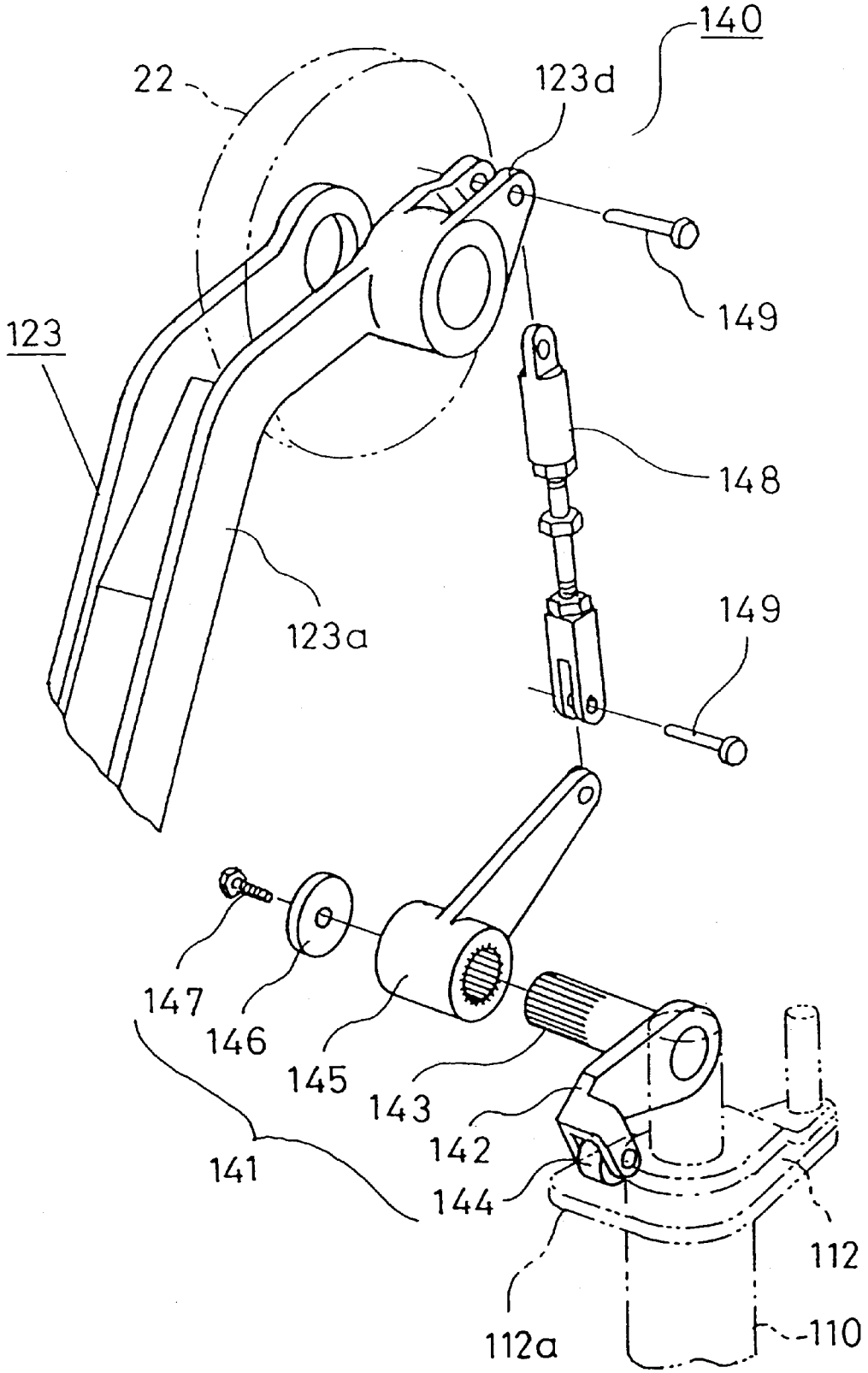
FIG. 25 is an explanatory view of component parts for the link rotation drive unit in FIG. 23.

In FIGS. 23, 24 and 25, a lever axle 143, fixed to a first lever 142, is attached to the front end portion of the top boom 6, and a roller 144 is attached to the front end portion of the first lever 142. One end of a second lever 145 is fixed to the front end portion of the lever axle 143 with a serration or a key. The second lever 145 is tightened with a plate 146 and a bolt 147. An intermediate lever 141 comprises the aforesaid members. A fork end lever 123*d*, which is fixed to the base end portion of the upper link 123*a* of the single top link 123, is rotatably attached to the guide sheave axle 124, provided on the upper portion of the top boom 6. The other end of the second lever 145 is connected to the fork end lever 123*d* via a connecting rod 148 with pins 149.

The lower end of the roller 144 of the first lever 142 comes close to the upper face of a lower plate 112*a* of the third link 112, which is fixed on the cylinder lock 110, when the cylinder lock 110 is shortened. When the cylinder lock 110 is extended, the lower plate 112*a* abuts on the roller 144, pushes up the same, and subsequently rotates the single top link 123 by rotating the first lever 142. This rotation allows the end sheave 23 to be raised upwardly.

Figure 26:
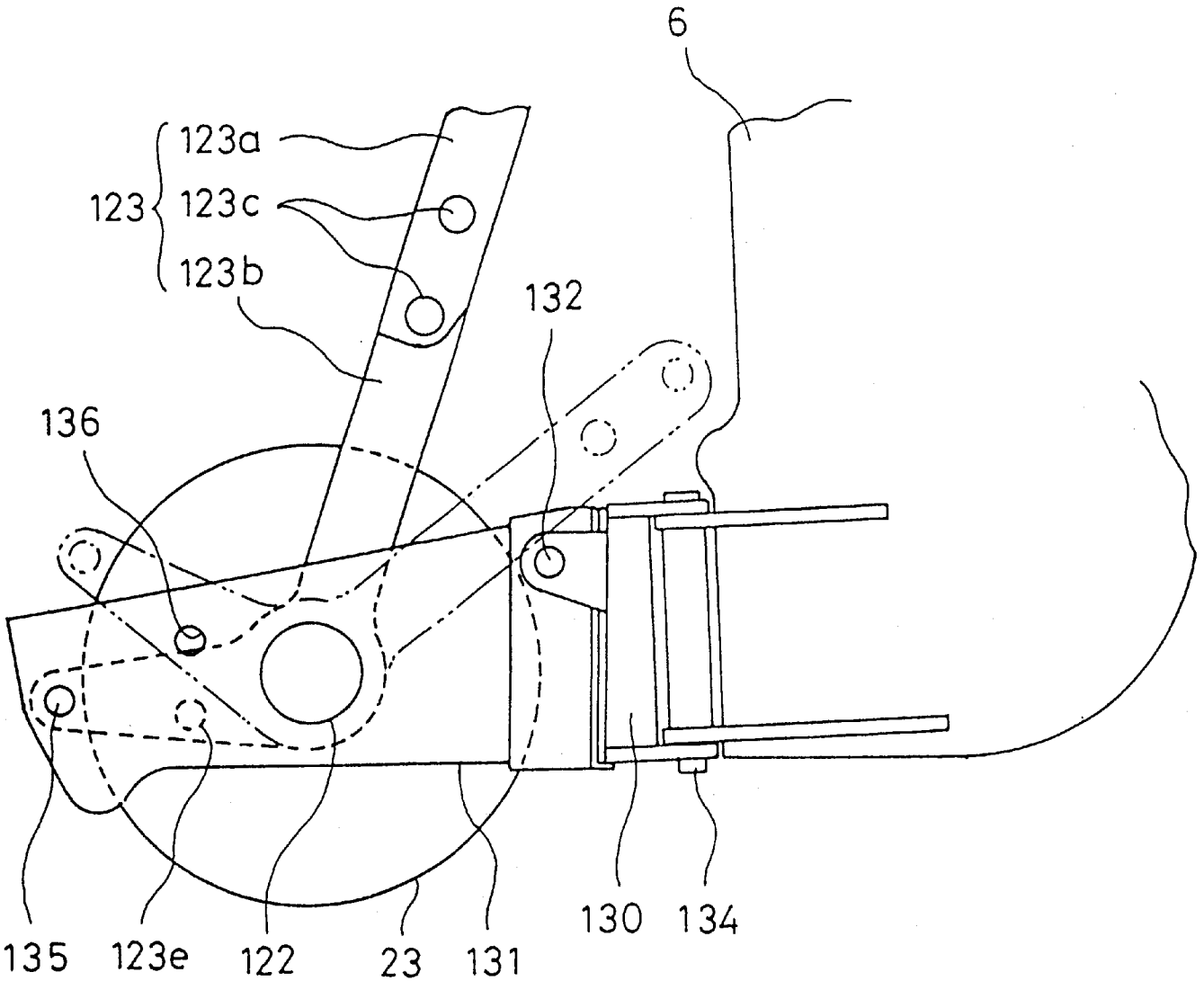
FIG. 26 is a side elevational view of a single top portion in the third embodiment of the present invention.
Figure 27:
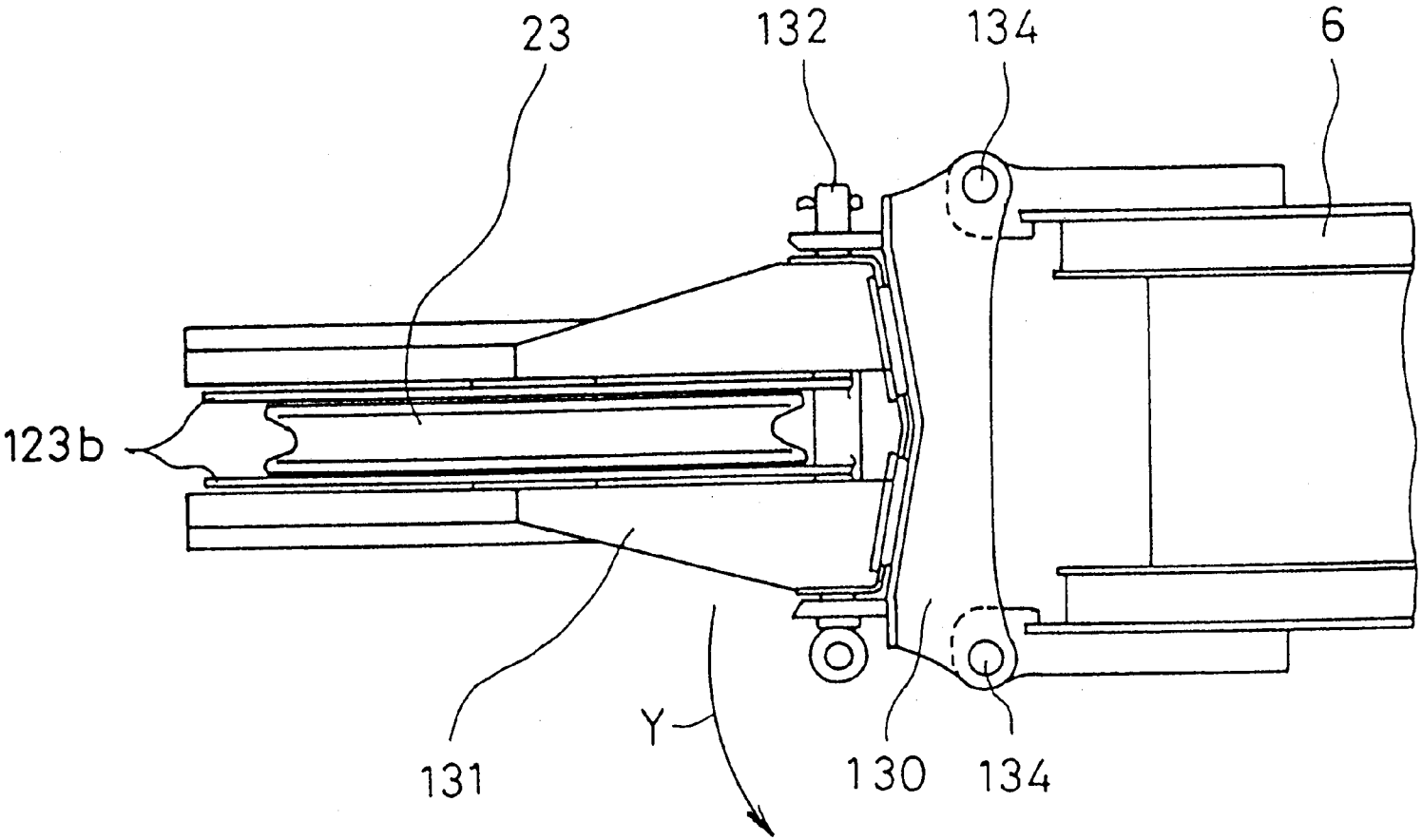
FIG. 27 is a plan view of the single top portion in FIG. 26.

In FIGS. 26 and 27, the bracket 130 is detachably attached to the front lower portion of the top boom 6 via a pair of pins 134 and 134 on both sides. If one of the pins 134 (for example, the upper pin in FIG. 27) is removed, the bracket 130 is rotatable on the other pin 134 (the lower pin in FIG. 27) in a lateral direction as shown by an arrow Y in FIG. 27. The single top 131, to which the end sheave 23 and the lower link 123*b* are attached via the end sheave axle 122, is detachably attached to the bracket 130 by the securing pin 132.

One end of the lower link 123*b* of the single top link 123 is connected to the upper link 123*a* by the connecting pins 123*c* and the other end thereof is positioned at the single top 131 by a positioning pin 135. The connecting pins 123*c* are removed to release the connection with the upper link 123*a*. Subsequently, the positioning pin 135 is removed and the lower link 123*b* is rotated to the position shown with a chain double dashed line (FIG. 26). Then, the positioning pin 135 is inserted through a pin-hole 136 of the single top 131 and a pin-hole 123*c* of the lower link 123*b*, both of which are aligned, so that the lower link 123*b* can be located at the position shown with a chain double dashed line.

Figure 28:
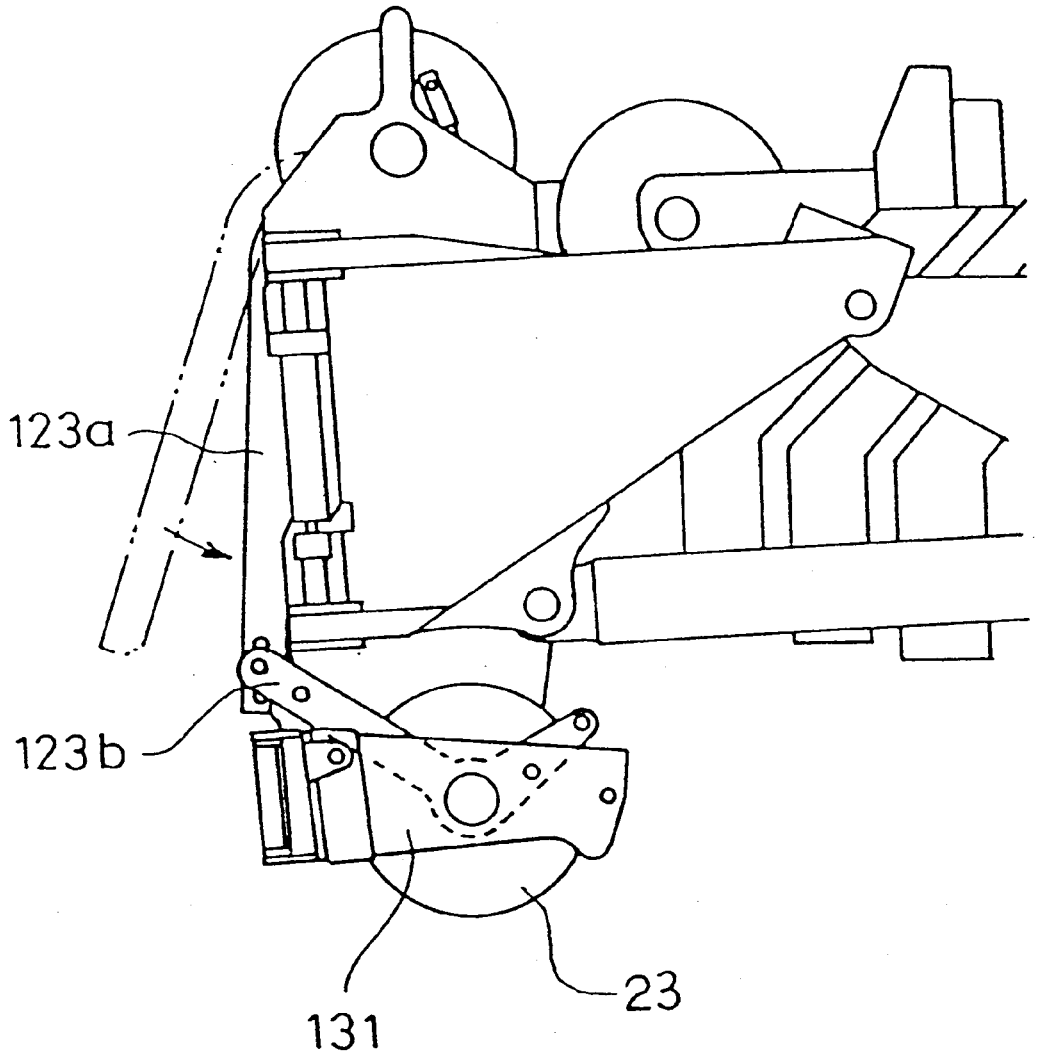
FIG. 28 is a side elevational view of the single top portion in a stored state in the third embodiment of the present invention.

After the lower link 123*b* is positioned as shown with the chain double dashed in FIG. 26, one of the pins 134 of the bracket 130 is removed. Subsequently, after the bracket 130 is rotated on the other pin 134 in the direction of the arrow Y shown in FIG. 27, the single top 131 is stored as shown in FIG. 28. At this time, the upper link 123*a* is rotated from the position shown with a chain double-dashed line to the position shown with a full line in the direction of an arrow so as to be stored.

Next, the process of changing the wire rope 21 when the jib 7 is extended and stored will be described.

Process 1: As shown in FIG. 22, after the upper link 123*a* and the lower link 123*b* are connected with the connecting pins 123*c*, the securing pin 132 is removed to detach the single top 131 from the bracket 130.

Figure 29:
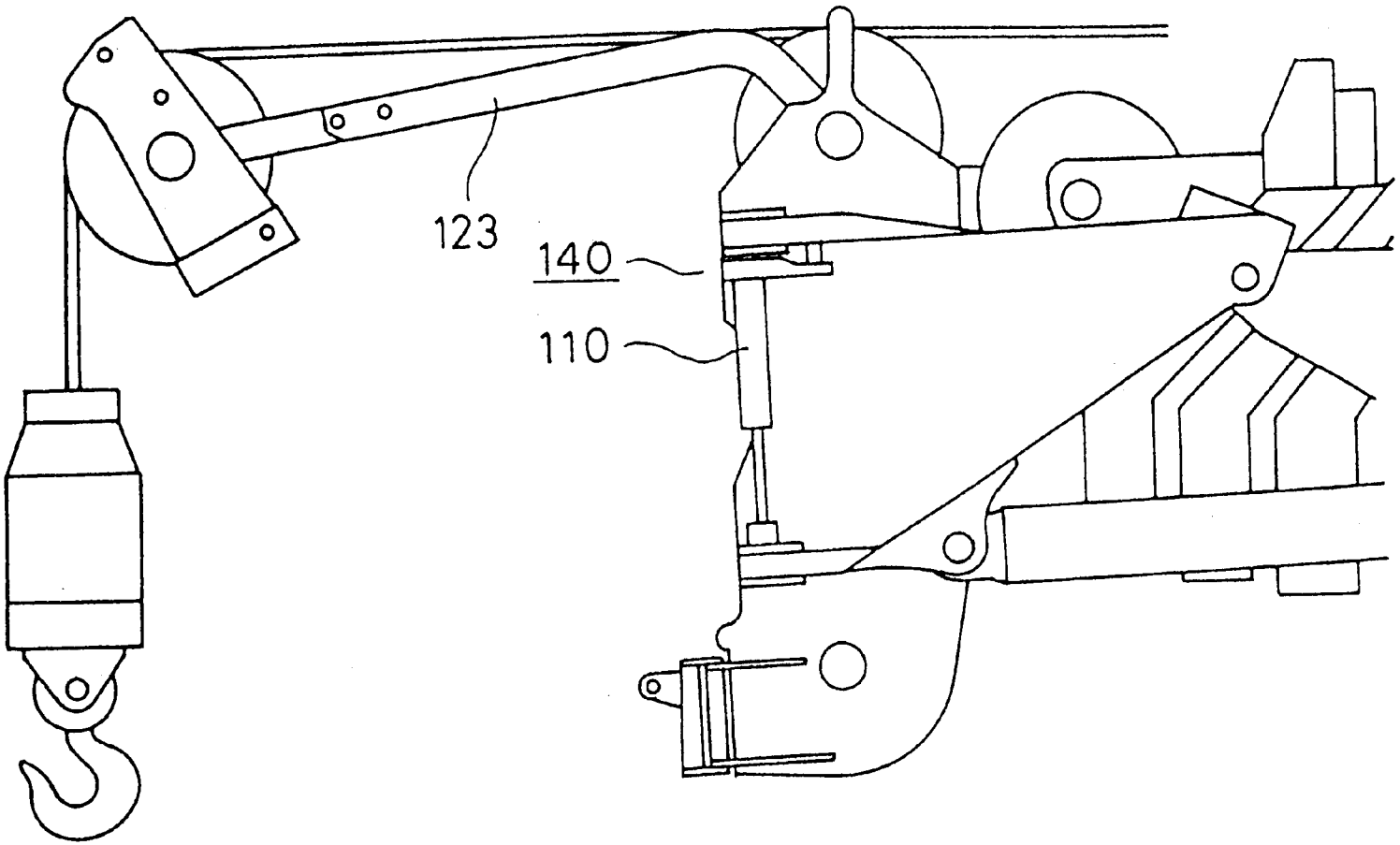
FIG. 29 is an explanatory view of a second process of changing the wire rope according to the third embodiment of the present invention.

Process 2: After the jib 7 is swung outwardly as shown in FIG. 19 and the cylinder lock 110 is extended as shown in FIG. 20, one side of the top boom 6 and one side of the rotary bracket 30 are connected by the first connecting pin 113 and the third connecting pin 117. At this time, as described above, the single top link 123 is rotated upwardly by the link rotation drive unit 140 as shown in FIG. 29.

Figure 30:
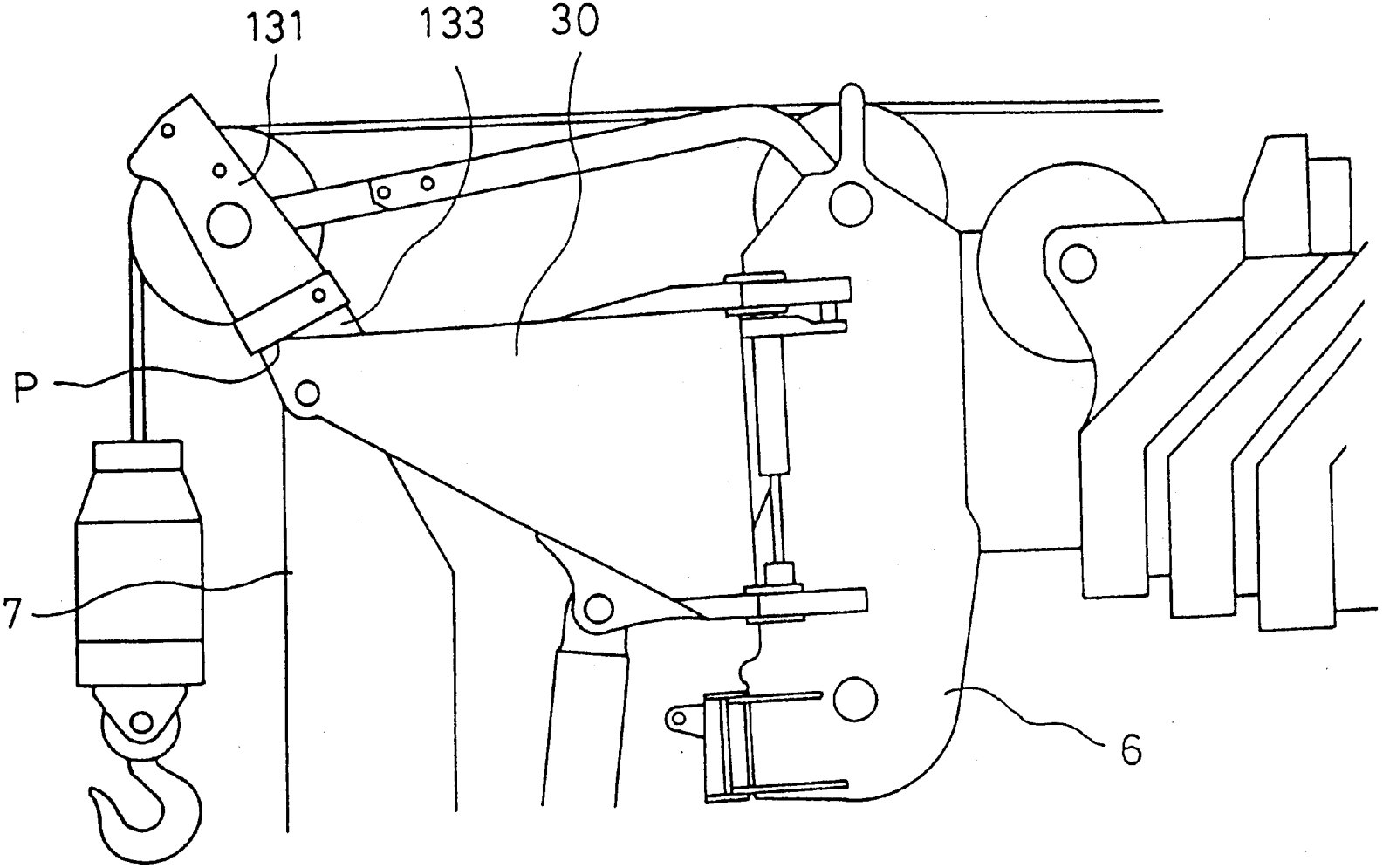
FIG. 30 is an explanatory view of a third process of changing the wire rope according to the third embodiment of the present invention.

Process 3: As shown in FIG. 30, the jib 7 is turned downwardly and the rotary bracket 30 is rotated 180 degrees to extend the jib 7 in front of the top boom 6. At this time, the supporting base 133 on the rotary bracket 30 abuts on the lower face P of the single top 131 and supports the same.

The aforesaid operations are extremely easy, since the single top link 123 is raised to a predetermined position while the lock cylinder 110 is extended.

Figure 31:
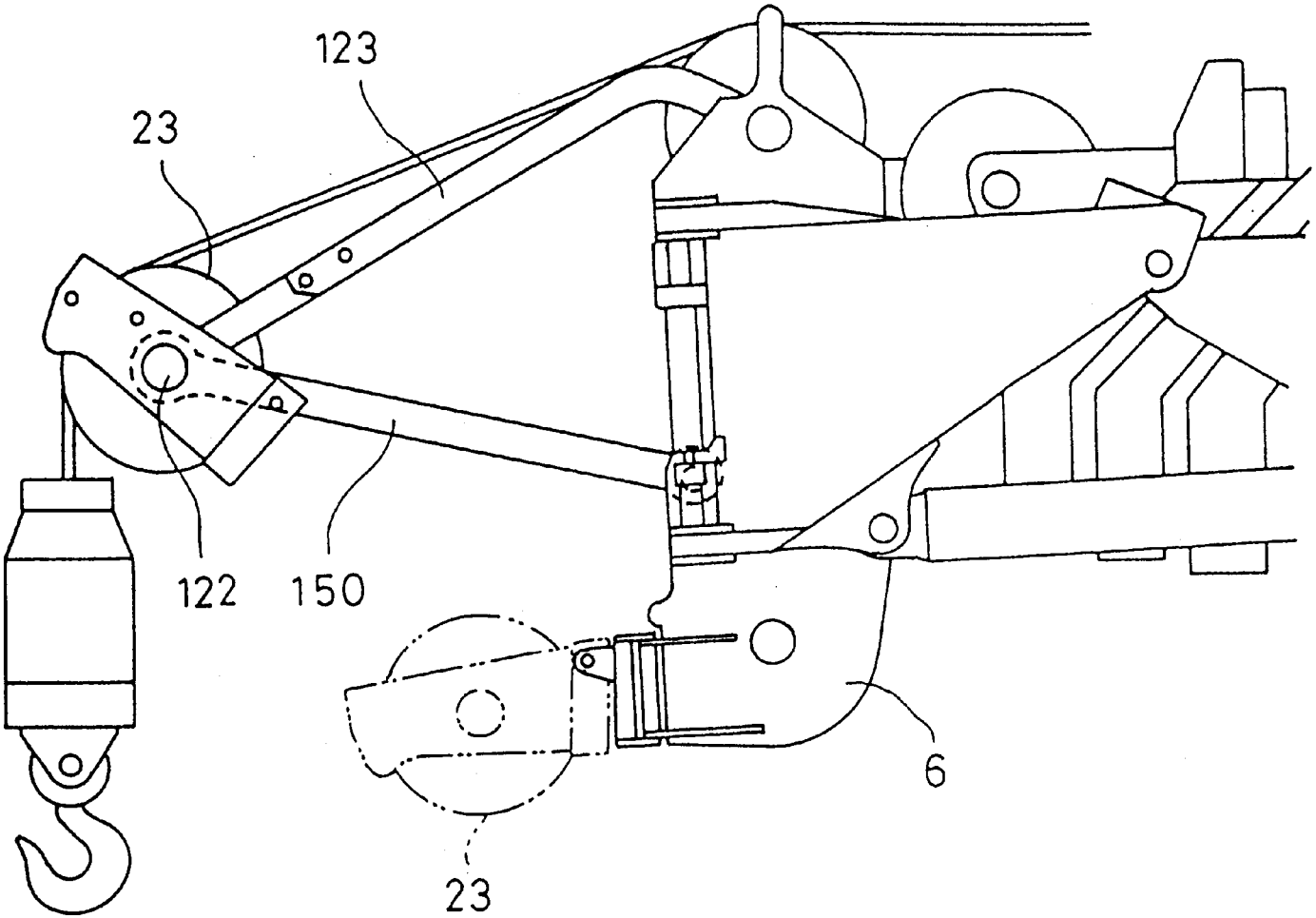
FIG. 31 is an explanatory view of a method for utilizing a single top link in the present invention.
Figure 32:
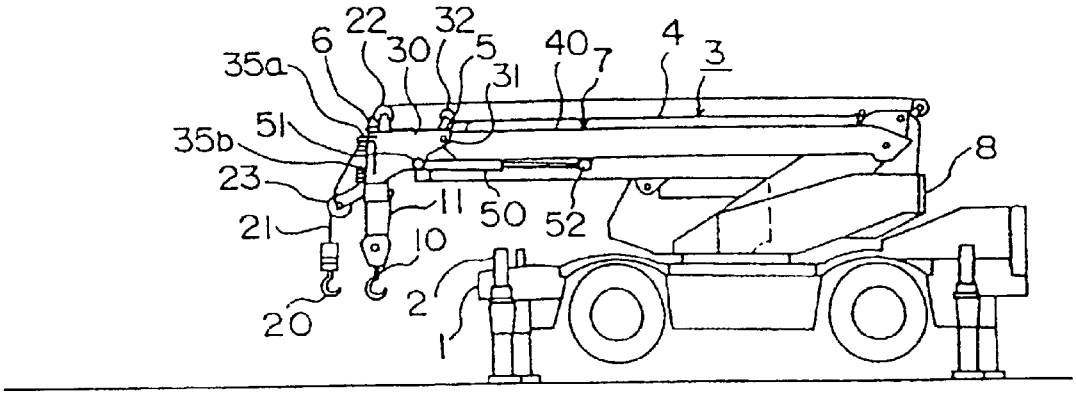
FIG. 32 (Prior Art)
FIG. 32 is a side elevational view illustrating a device for changing a wire rope according to the conventional art.
Figure 33:
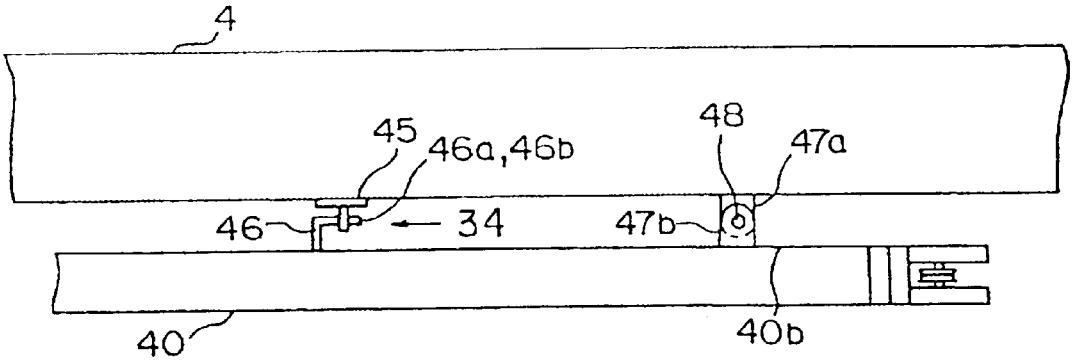
FIG. 33 (Prior Art)
FIG. 33 is a plan view showing the state of a jib body being fixed to a base boom in the device for changing the wire 9 rope in FIG. 32.
Figure 34:
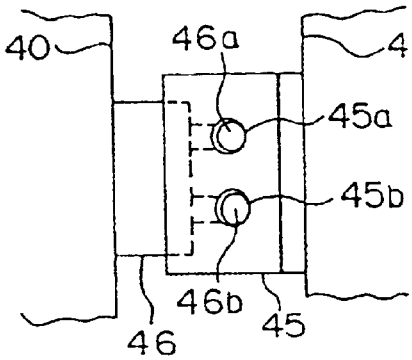
FIG. 34 (Prior Art)
FIG. 34 is a drawing seen from an arrow 34 in FIG. 33.
Figure 35:
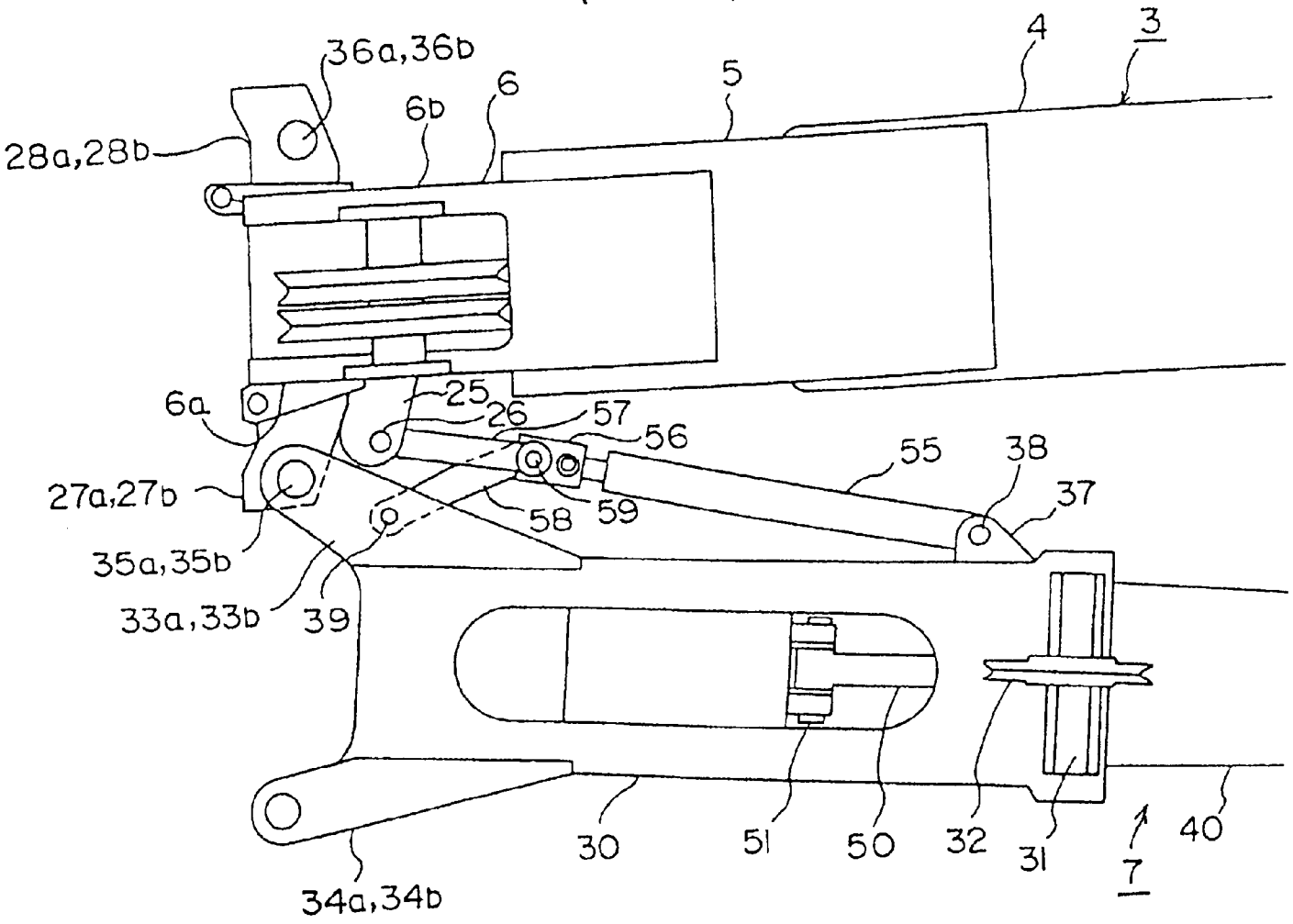
FIG. 35 (Prior Art)
FIG. 35 is a plan view of a jib connecting portion in the device for changing the wire rope according to the conventional art.
Figure 36:
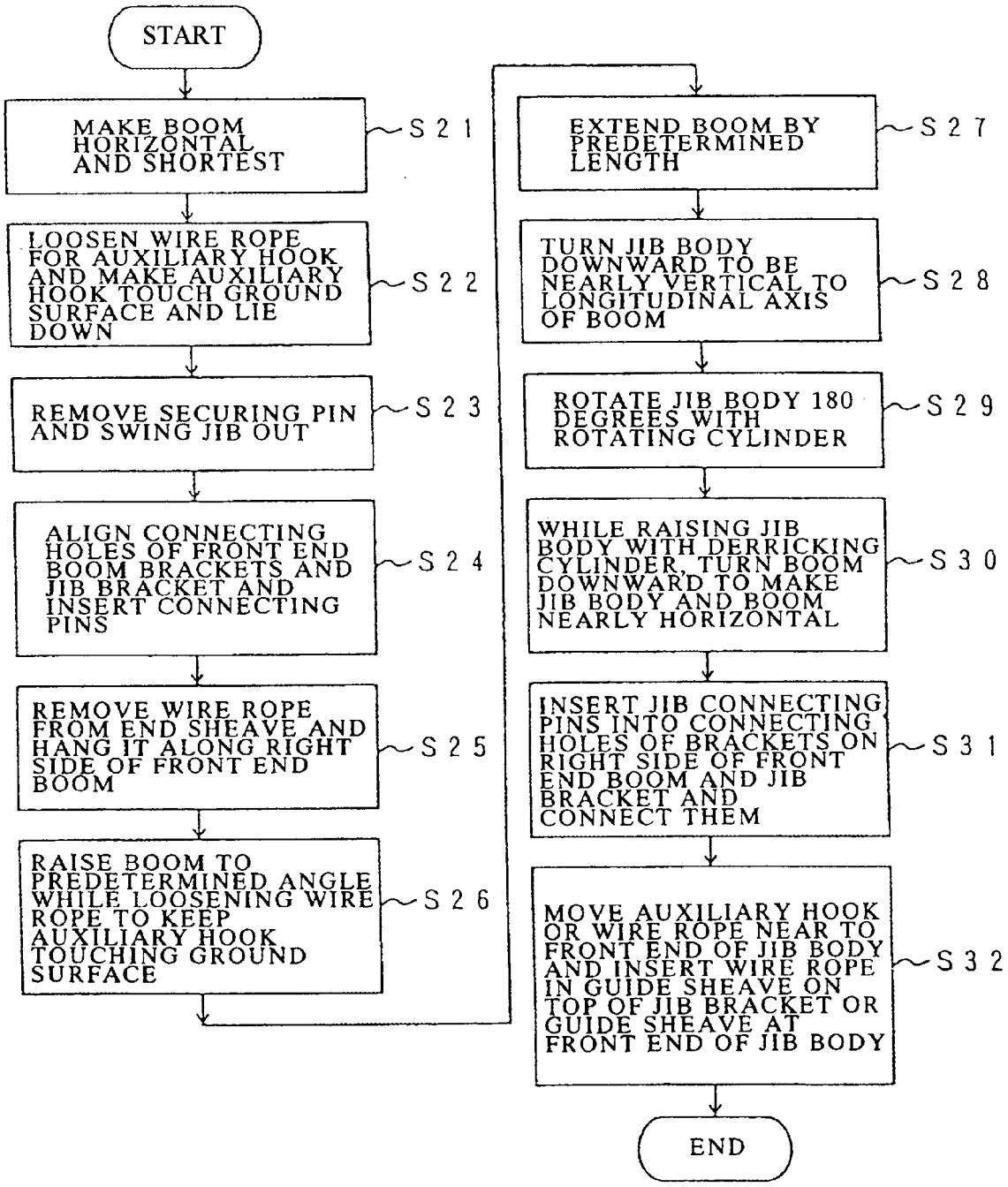
FIG. 36 (Prior Art)
FIG. 36 is a flowchart describing a processing of a method for changing the wire rope according to the conventional art.
Figure 37:
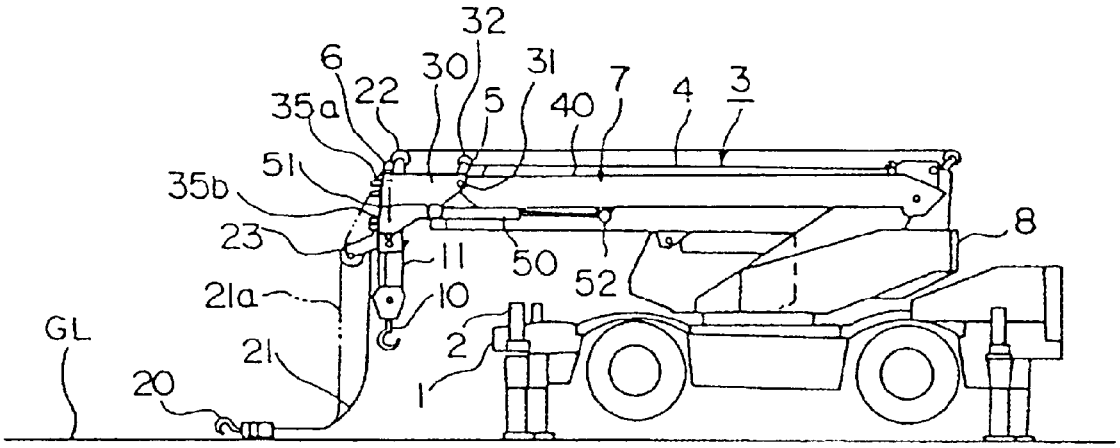
FIG. 37 (Prior Art)
FIG. 37 is an explanatory view showing the initial state in the processing of the method for changing the wire rope according to the conventional art.
Figure 38:
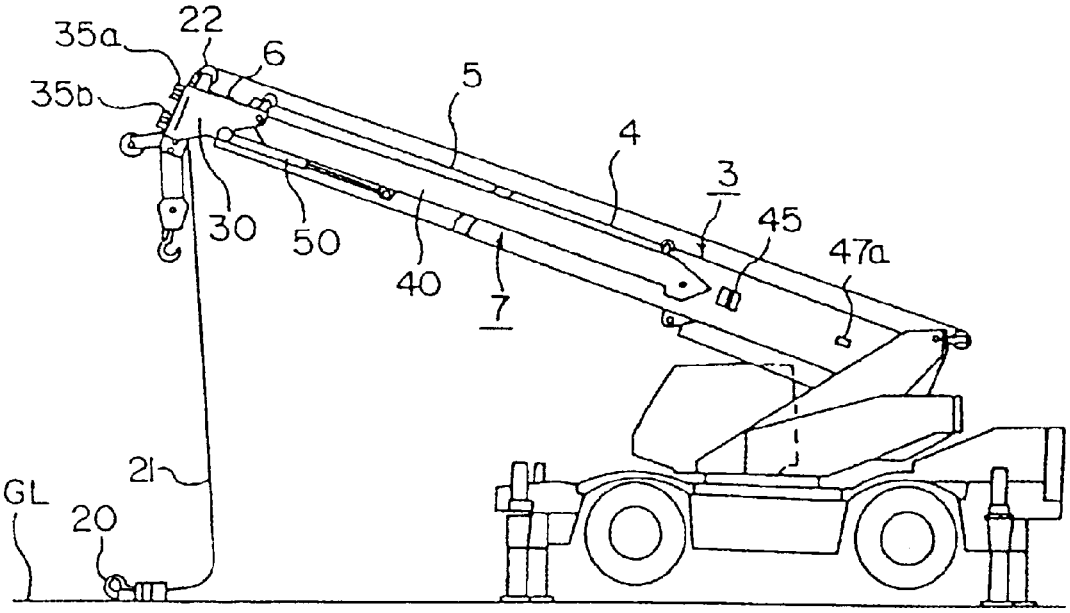
FIG. 38 (Prior Art)
FIG. 38 is an explanatory view showing the state of a boom being extended from the shortest state thereof by a predetermined length (the state of S27) in the method for changing the wire rope according to the conventional art.
Figure 39:
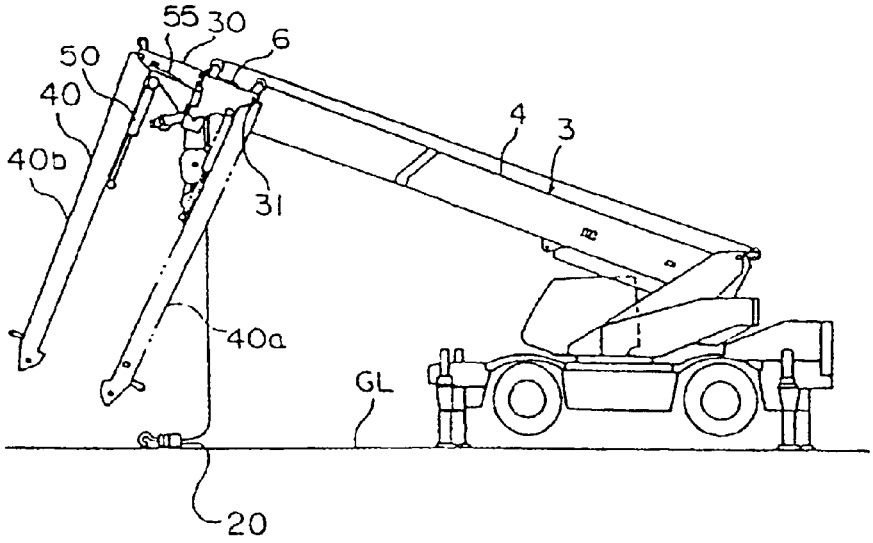
FIG. 39 (Prior Art)
FIG. 39 is an explanatory view showing the state of the jib body being nearly vertical to the longitudinal axis of the boom (the state of S28) in the method for changing the wire rope according to the conventional art.
Figure 40:
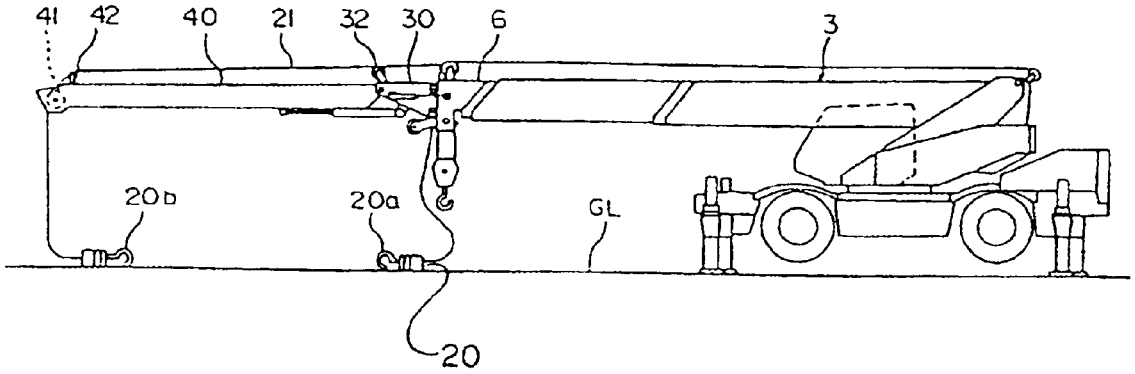
FIG. 40 (Prior Art)
FIG. 40 is an explanatory view showing the state of the jib body and the boom being nearly horizontal (the state of S30) in the method for changing the wire rope according to the conventional art.

FIG. 31 shows another way of utilizing the end sheave 23, which is attached to the front end of the single top link 123. Specifically, the single top link 123 is rotated by a predetermined angle to raise the end sheave 23, and the end sheave axle 122 and the front end portion of the top boom 6 are connected via a supporting link 150. Thus, the end sheave 23 can be supported at a position higher than a position shown with a chain double-dashed line. As a result, this way can be used to raise a lift in a site with a limited space for lifting. Moreover, in the state that the jib 7 is extended as shown in FIG. 9, the end sheave 23 can be used also as the guide sheave 23 for the wire rope 21 for the auxiliary hook 20.

As described in detail above, in the present invention, when the end sheave 23, which is rotatably attached to the front end of the top boom 6, is raised forwardly and upwardly and the jib 7 is turned downwardly and rotated 180 degrees in the forward direction of the top boom 6, the jib 7 is intended to be nearly vertical to a ground surface. Thus, the wire rope 21 can be automatically inserted into the end sheave 23 of the jib 7 by hanging the auxiliary hook 20 near the ground surface and raising the jib 7. Consequently, operators no longer need to carry the auxiliary hook 20 or the wire rope 21 or to insert the wire rope 21 in the end sheave 23, whereby the operation of changing the wire rope 21 can be facilitated and shortened in time.

In addition, the position of the fifth through pin-hole 105*c* of the second link 104 is fixed when the rotating cylinder 106 is shortened, and the top boom first pin-hole 82*a* and the top boom third pin-hole 84*a* on one side of the top boom 6 and the first through pin-hole 91*c* and the second through pin-hole 93*c* on one side of the rotary bracket 30 are aligned when the jib 7 is extended. Besides, the top boom fourth pin-hole 85*a* and the top boom fifth pin-hole 86*a* on the other side of the top boom 6 and the third through pin-hole 94*c* and the fourth through pin-hole 95*c* on the other side of the rotary bracket 30 are aligned. Thus, the connection of the top boom 6 and the rotary bracket 30 can be conducted more easily and in a shorter time.

Industrial Availability

The present invention is useful as an apparatus and a method for extending and storing a jib of a crane which makes it possible to easily attach and detach an auxiliary hook, without carrying the auxiliary hook and a wire rope, and to simplify the operation of changing the wire rope.

We claim:

1. A crane comprising:

a boom;

a jib, which can be stored parallel to a side face of said boom;

a rotary bracket, which is rotatably attached to a front end of said boom and which is attached to said jib so that rotation of said rotary bracket can swing said jib outwardly from said side face of said boom to a position in front of said boom wherein said jib is connected to said boom at a front end portion of said boom when said jib is to be used;

an end sheave, which is detachably attached to a lower portion of a front end of said boom;

a rotating device, for rotating said rotary bracket; and a first connecting link for vertically rotatably connecting said end sheave and a front upper portion of said boom and for positioning said end sheave above and in front of said boom; and wherein rotation of said rotary bracket in a forward direction of said boom causes said end sheave to be located above said rotary bracket and to be resting thereupon.

2. A crane in accordance with claim 1, wherein said end sheave also serves as a guide sheave for a wire rope for an auxiliary hook when said jib is extended.

3. A crane in accordance with claim 1, further comprising:

a jib derricking cylinder, connecting said rotary bracket and said jib; and wherein, when said jib derricking cylinder has turned said jib downwardly from a storing position of said jib and said rotating device has rotated said jib in the forward direction of said boom, said jib is nearly vertical to a ground surface and a relative angle between said jib and said boom is not more than about 85 degrees.

4. A crane in accordance with claim 3, wherein a position of a center of gravity of said jib is nearly on a rotation center line of said rotary bracket in relation to said boom when said jib is turned downwardly from said storing position and rotated in the forward direction of said boom.

5. A crane in accordance with claim 3, further comprising:

a guide sheave, which is attached to a front end portion of said jib; and a load sheave, which is attached to a front end of said jib; and wherein said end sheave, said guide sheave, and said load sheave are at least substantially on a straight line as seen from ahead when said jib is nearly vertical to the ground surface.

6. A crane in accordance with claim 1, further comprising a link rotation drive unit for rotating said first connecting link.

7. A crane in accordance with claim 6, further comprising a second connecting link for connecting a front end portion of said first connecting link and the front end portion of said boom when said first connecting link is rotated upwardly to a predetermined position.

8. A crane in accordance with claim 6, wherein said link rotation drive unit comprises:

a cylinder lock which connects one end portion of said boom and one end portion of said rotary bracket, both in a lateral direction;

an intermediate lever, driven by said cylinder lock; and a connecting rod connecting said first connecting link and said intermediate lever.

9. A crane in accordance with claim 1, wherein said rotating device comprises:

a first link, a first end of which is rotatably attached to a pin which is fixed on an upper face of said rotary bracket;

a second link, a first end of which is rotatably attached to a second end of said first link;

a cylinder lock connecting in an extended condition one end portion of said boom and one end portion of said rotary bracket, both in a lateral direction;

a third link which is rotatably attached to said cylinder lock, a front end of said third link being rotatably connected to a second end of said second link; and a rotating cylinder, one end of which is connected to said rotary bracket and another end of which is connected to said first link.

10. A crane in accordance with claim 9, wherein said rotary bracket includes:

a base end having a first side and a second side;

a first through pinhole located in said first side of said base end;

a second through pinhole located in said first side of said base end;

a third through pinhole located in said second side of said base end; and a fourth through pinhole located in said second side of said base end; and wherein said crane further comprises:

a first connecting pin positioned vertically and engaging said first through pinhole and a first side of the front end of said boom; and a third connecting pin positioned vertically and engaging said second through pinhole and said first side of the front end of said boom;

whereby a vertically positioned connecting pin can engage said third through pinhole and a first side of the front end of said boom; and whereby a vertically positioned connecting pin can engage said fourth through pinhole and said first side of the front end of said boom.

11. A crane in accordance with claim 9, wherein the second end of said second link includes a fifth through pinhole, and wherein a second connecting pin engages said fifth through pinhole and the front end of said third link.

12. A crane in accordance with claim 9, wherein said cylinder lock includes:

a cylinder;

a piston rod extending through a front end of said cylinder;

a first connecting pin located at a rear end of said cylinder;

a second connecting pin located at a front end of said third link; and a third connecting pin located at a front end portion of said piston rod;

said first connecting pin being engaged in a first through pinhole in a first side of a base end of said rotary bracket;

said third connecting pin being engaged in a second through pinhole in said first side of the base end of said rotary bracket; and said second connecting pin engaging a through pin hole in said second end of said second link.

13. A crane in accordance with claim 9, further comprising a positioning means for positioning a second connecting pin on the front end of said third link at a predetermined position when said rotating cylinder is contracted.

14. A crane in accordance with claim 9, further comprising a positioning means for adjusting a relative position between said rotary bracket and the front end of said boom when said rotary bracket is swung outwardly in the forward direction of said boon.

15. A method for extending and storing a jib of a crane wherein a wire rope for an auxiliary hook is guided by an end sheave, disposed at a lower portion of a front end of a boom, and wherein said wire rope needs to be changed when a jib is moved between an extended position and a storage position on a side face of said boom, said method comprising the steps of:

at a time of extending said jib, moving said end sheave to be above and in front of said boom;

then pivoting said jib downwardly from said storage position;

then rotating said jib in a forward direction of said boom to make said jib nearly vertical to a ground surface; and then raising said jib forwardly so that the wire rope is automatically inserted into a guide sheave at a front end of said jib.

* * * * *